US010048037B2

(12) United States Patent
Peacemaker et al.

(10) Patent No.: US 10,048,037 B2
(45) Date of Patent: Aug. 14, 2018

(54) ARCHERY BOW

(71) Applicant: SOS Solutions, Inc., Spokane, WA (US)

(72) Inventors: Samuel R. Peacemaker, Spokane, WA (US); Benjamin Peacemaker, Spokane, WA (US); Zachary Peacemaker, Spokane, WA (US)

(73) Assignee: SOS Solutions, Inc., Spokane, WA (US)

( * ) Notice: Subject to any disclaimer, the term of this patent is extended or adjusted under 35 U.S.C. 154(b) by 0 days.

(21) Appl. No.: 14/801,107

(22) Filed: Jul. 16, 2015

(65) Prior Publication Data

US 2015/0323280 A1 Nov. 12, 2015

Related U.S. Application Data

(63) Continuation of application No. 13/610,682, filed on Sep. 11, 2012, now Pat. No. 9,086,249.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/105* (2013.01)

(58) Field of Classification Search
CPC ..... F41B 5/10; F41B 5/105
See application file for complete search history.

(56) References Cited

U.S. PATENT DOCUMENTS

| | | | | |
|---|---|---|---|---|
| 4,368,718 | A * | 1/1983 | Simonds | F41B 5/105 124/25.6 |
| 6,082,347 | A | 7/2000 | Darlington | |
| 6,360,735 | B1 | 3/2002 | Larson et al. | |
| 6,499,478 | B1 | 12/2002 | Perez | |
| 6,575,153 | B2 | 6/2003 | Lommasson et al. | |
| 7,082,937 | B1 | 8/2006 | Land | |
| 7,216,643 | B2 | 5/2007 | Pellerite | |
| 7,673,626 | B1 | 3/2010 | Hennings | |
| 9,086,249 | B2 * | 7/2015 | Peacemaker | F41B 5/10 |

* cited by examiner

*Primary Examiner* — John Ricci
(74) *Attorney, Agent, or Firm* — Robert D. Atkins; Patent Law Group: Atkins and Associates, P.C.

(57) ABSTRACT

An archery bow is described, and which has a resilient, main body having opposite distal ends; a biasing member is borne by the main body; and a string extends, and is tensioned between the distal ends, and wherein the string has a first, at rest position; a second, arrow release position; and a third, string return position, and wherein the biasing member applies a biasing force to resist the movement of the string from the third, string return position, to the first, at rest position, and a biasing force to assist in the movement of the string from the first, at rest position, to the second, arrow release position.

27 Claims, 33 Drawing Sheets

ARCHERY BOW

The present Application is a continuation of U.S. patent application Ser. No. 13/610,682, now U.S. Pat. No. 9,086, 249, filed Sep. 11, 2012, which is incorporated herein by reference.

TECHNICAL FIELD

The present invention relates to an archery bow, and more specifically to an archery bow which assists an archer in both drawing an arrow to an arrow release position, and then returning a previously drawn arrow to an at rest position, in a manner not possible, heretofore.

BACKGROUND OF THE INVENTION

Various types of archery bows have been developed and which include traditional bows, that is, longbows and recurved bows, and more recently compound bows. As a general matter, all archery bows include a pair of opposed limbs extending outwardly from the opposite ends of a handle of the bow. As an archer draws the bow by pulling on a string or cable, the limbs flex and store energy. This energy is then transferred to the arrow as the archer releases the string or cable.

The limbs of a compound bow are generally much stiffer than those of a recurved bow or a longbow. This limb stiffness makes the compound bow more energy-efficient than other archery bows when used in conjunction with the pulley/cams as employed in modern compound bow construction. As is generally known, the compound bow has a string or cable which is applied to a variety of differently designed pulleys or cam shaped members. Further, the compound bow has one or more pulleys or cams which have other cables attached to the opposite limbs. When the string is drawn back, the string causes the pulleys or cams to turn. As force is applied, and as this draw continues, an archer has a reduced mechanical advantage, but during the draw as the pulley or cams rotate, and the archer gains mechanical advantage over the bending limbs, more energy is stored in the limbs in comparison to other archery bows. Generally speaking, the use of this well known leveraging system gives the compound bow a characteristic draw-force curve, which rises to a peak weight, and then, lets off, or reduces dramatically to a lower holding weight. This feature of the compound bow permits the archer to draw the arrow and then maintain aim on their target, prior to the release of the arrow, for a longer period of time thereby resulting in a better aimed shot. Generally speaking, one of the principal objectives of most archery bow design is to increase the speed at which an arrow is projected or propelled by a bow. Arrows which fly faster can maintain a flatter trajectory over a greater distance than slower traveling arrows. This enables faster flying arrows to be fired more accurately than slower traveling arrows.

While the various designs of compound bows have operated with various degrees of success, assorted shortcomings have detracted from their usefulness. One of the chief shortcomings to the compound bows that have been developed so far is that the strength required by the archer to draw the string or cable to an arrow release position steadily increases as the bow strength increases. While the assorted cams and other leverage achieved by the previous compound bow designs have reduced the amount of strength that the archer needs to have to hold the string at a full, arrow release position, the archer must still have a certain amount of strength, which will permit the archer to first draw the arrow, and then return the arrow from an arrow release position, to an at rest position in the event that the archer does not release the arrow at a target. Those skilled in the art recognize that bringing a compound bow back to an at rest position, from a previous, fully drawn position often requires a bit of strength, and talent, in order to prevent uncontrolled movement of the bow as the arrow is being returned. This is particularly important to hunters, especially when an archer is shooting from a camouflaged position, or from a tree stand, and the like, and where an excessive amount of movement of the bow could have the effect of scaring-off a potential animal target.

An archery bow which addresses these and other shortcomings attendant with the prior art archery bows, and other devices employed with archery bows, heretofore, is the subject matter of the present invention.

SUMMARY OF THE INVENTION

A first aspect of the present invention relates to an archery bow which includes a resilient main body having opposite, distal ends; a biasing member borne by the main body; and a string extending to, and tensioned between, the distal ends, and wherein the string has a first, at rest position; a second, arrow release position; and a third, string return position, and wherein the biasing member biasingly resists the movement of the string from the third, string return position, to the first, at rest position.

Still another aspect of the present invention relates to an archery bow which includes a first and a second limb each having a distal end; a handle located between, and mounted to, each of the first and second limbs; a first rotating member mounted on the distal end of one of the first or second limbs; a second rotating member mounted on the distal end of one of the first or second limbs, and which is selectively co-rotatable with the first rotating member; a first biasing member which applies a biasing force on the first and second rotating members during the co-rotation thereof; and a string extending between the first rotating member and the opposite limb.

Still another aspect of the present invention relates to an archery bow which includes a first and second limb each having a distal end, and wherein the distal end of each of the first and second limbs is defined by spaced, first and second forked members; a handle located between, and mounted to each of the first and second limbs; an axle rotatably mounted on the distal end of the first and second limbs and extending between the spaced, first and second forked members; a biasing member, located between at least one of the forked members; a first rotating member having a peripheral edge, and which is rotatably mounted on the axle, and which is further operable to rotate in a first, or in an opposite, second direction; a string engaging the peripheral edge of the first rotating member, and extending between the first rotating member and the opposite limb, and wherein the string has a first, at rest position; a second, arrow release position; and a third, string return position; a moveable pawl borne by the first rotating member, and which is operable to move along a path of travel from a first to a second position, and wherein the moveable pawl has an engagement member; a force transmitting portion; and a camming surface; a resilient restraining member movably borne by the first rotating member, and which engages the camming surface of the moveable pawl, and wherein the resilient restraining member causes the moveable pawl to be resiliently restrained in either the first position, or the second position; a rotating camming member rotatably borne by the first rotating member, and which is located in spaced relation relative to the resilient restraining member, and wherein rotation of the rotating camming member is effective in moving the resilient restraining member out of engagement with the camming surface of the resilient restraining member, and wherein the rotating camming member has a first and a second end; a second biasing member borne by the first rotating member, and which is effective in causing the moveable pawl to move along the path of travel from the second, to the first position, when the resilient restraining member is moved out of engagement with the moveable pawl by the rotation of the rotating camming member; a second rotating member mounted on the axle, and co-rotating therewith, and wherein the second rotating member is mounted in substantially parallel, spaced relation relative to the first rotating element, and wherein the biasing member biasingly engages the second rotating member, and wherein the second rotating member has a peripheral edge which defines an engagement notch, and wherein the second rotating member further includes a support member which extends laterally, outwardly, relative to the peripheral edge of the second rotating member, and which is located in spaced relation relative to the first rotating member, and wherein a first and a second engagement post are individually mounted on the support member and extend in the direction of, but not into contact with, the first rotating member, and wherein an archer, upon placing an arrow into releasable engagement with the string, and in the first, at rest position, and further forcibly drawing the string from the first, at rest position, to the second, arrow release position causes the string to forcibly engage the peripheral edge of the first, rotating member and effect the simultaneous rotation of the first rotating member in the first direction, and wherein rotation of the first rotating member in the first direction carries the movable pawl to a location where the moveable pawl is located in spaced relation relative to the engagement notch as defined by the peripheral edge of the second rotating member, and wherein the release of the string from the second arrow release position causes the string to return to the first, at rest position, and forcibly propels the arrow away from the bow, and wherein the release of the string causes the first rotating member to rotate in the second direction, while the second rotating member remains substantially stationary relative to the first rotating member, and wherein, when the archer draws the string to the second, arrow release position, and further draws the string in the direction of the third, string return position, the first rotating member carries the first rotating camming member, and the moveable pawl, into forcible contact with the respective first and second posts which are mounted on the support member, and wherein further rotation of the first rotating member, in the first direction, is effective in first causing the first end of the rotating cam to engage the first post, and force the resilient restraining member out of forcible engagement with the camming surface of the movable pawl, and secondly, causes the engagement member of the moveable pawl to forcibly engage the second post, and thereby effect rotatable movement of the moveable pawl along the path of travel from the first position, to the second position, and against the biasing force exerted by the second biasing member on the moveable pawl, and wherein the controlled return or release of the string from the third, string return position, and in the direction of the first, at rest position, causes the simultaneous rotation of the first rotating member in the second direction, and further carries the force transmitting portion of the moveable pawl into the engagement notch, and into force transmitting relation relative to the second, rotating member, and wherein continued rotation of the first rotating member, in the second direction, is effective in causing co-rotation of each of the first and second rotating members, and wherein the biasing member biasingly resists the co-rotation of the first, and second rotating members, as the string moves from the third, string return position, to the first, at rest position.

These and other aspects of the present invention will be discussed in greater detail hereinafter.

BRIEF DESCRIPTION OF THE DRAWINGS

Preferred embodiments of the present invention are described, below, with reference to the following accompanying drawings.

DETAILED DESCRIPTION OF THE PREFERRED EMBODIMENT

This disclosure of the invention is submitted in furtherance of the constitutional purposes of the U.S. patent laws "to promote the progress of science and useful arts" [Art. 1, § 8].

Figure 1:
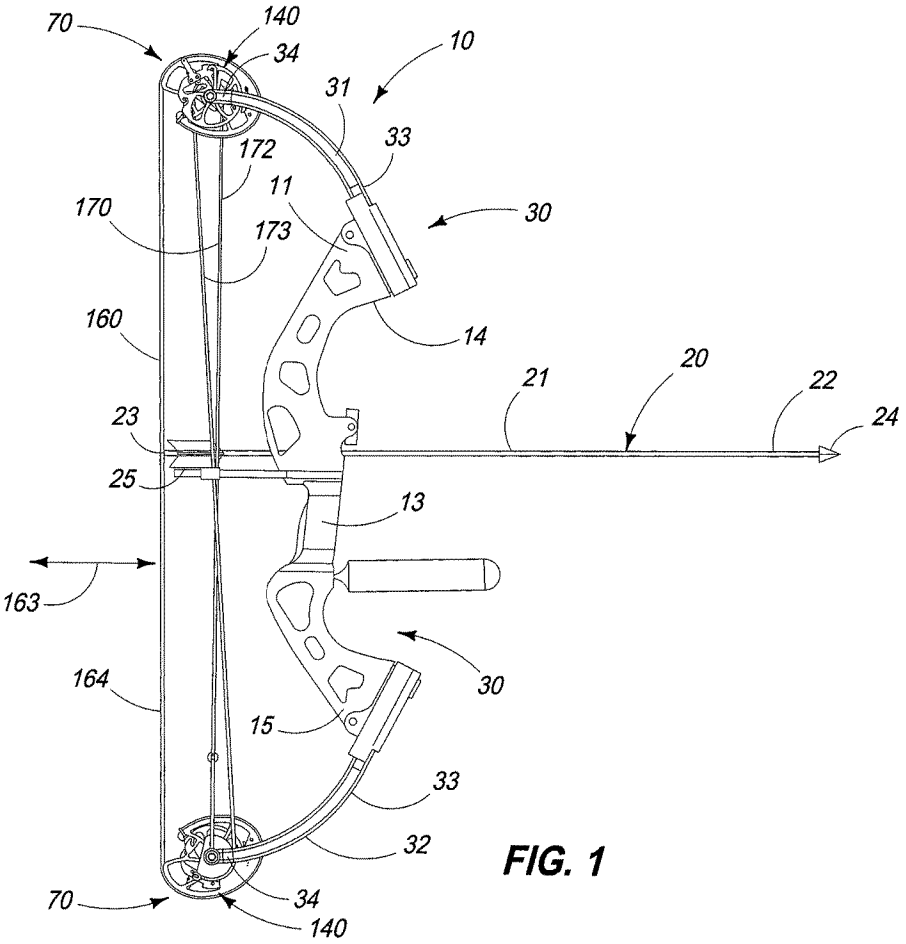
FIG. 1 is a side elevation view of a first form of the archery bow of the present invention and which is used, in combination with, an arrow of traditional design, and which is further shown in a first, at rest position.

An archery bow having the features of the present invention is generally indicated by the numeral 10 in FIG. 1, and following. The present archery bow 10 includes first and second forms which are indicated by the numerals 11 and 12, respectively, and which are best seen by reference to FIGS. 1 and 1A respectively. With regard to the first and second forms of the invention 11 and 12 respectively, common structures will be indicated by common numerals.

The first and second forms of the invention 11 and 12 each include a handle which is generally indicated by the numeral 13. The handle 13 has opposite first and second ends 14 and 15, respectively. The handle is operable to cooperate with an arrow 20 of traditional design. The arrow has a shaft 21, which has opposite, first and second ends, 22 and 23, respectively. An arrow tip or penetrator 24 is mounted on the first end 22 of the shaft. Further, the second end 23 is operable to releasably, mateably couple with a string, drawstring or cable, which will be discussed in greater detail, hereinafter. Closely adjacent to the second end 23 is a group of feathers or other air guides or surfaces 25, which are individually used to direct the arrow shaft 21 towards a given target, not shown.

As seen in FIG. 1, and following, the handle 13 is mounted to opposed, first and second limbs which are indicated by numerals 31 and 32, respectively. Each of the respective limbs 31 and 32 have a first end 33, which is mounted to the opposite first and second ends 14 and 15 of the handle 13. Further, the respective first and second limbs have a distal, second end 34, which is remote to the first end. The first and second limbs are defined by first and second forked members 35 and 36, respectively. The individual forked members 35 and 36 are individually affixed to the opposite ends 14 and 15 of the handle 13. As best seen in the drawings, a gap 37 is defined between the first and second forked members, and is operable to receive first and second rotating members therein. These respective rotating members will be discussed in greater detail in the paragraphs which follow. The combination of the handle, and the first and second limbs 31 and 32, respectively, define a resilient main body 30, which is operable to propel the arrow 20 toward a target as (not shown) will be discussed, below.

Figure 3:
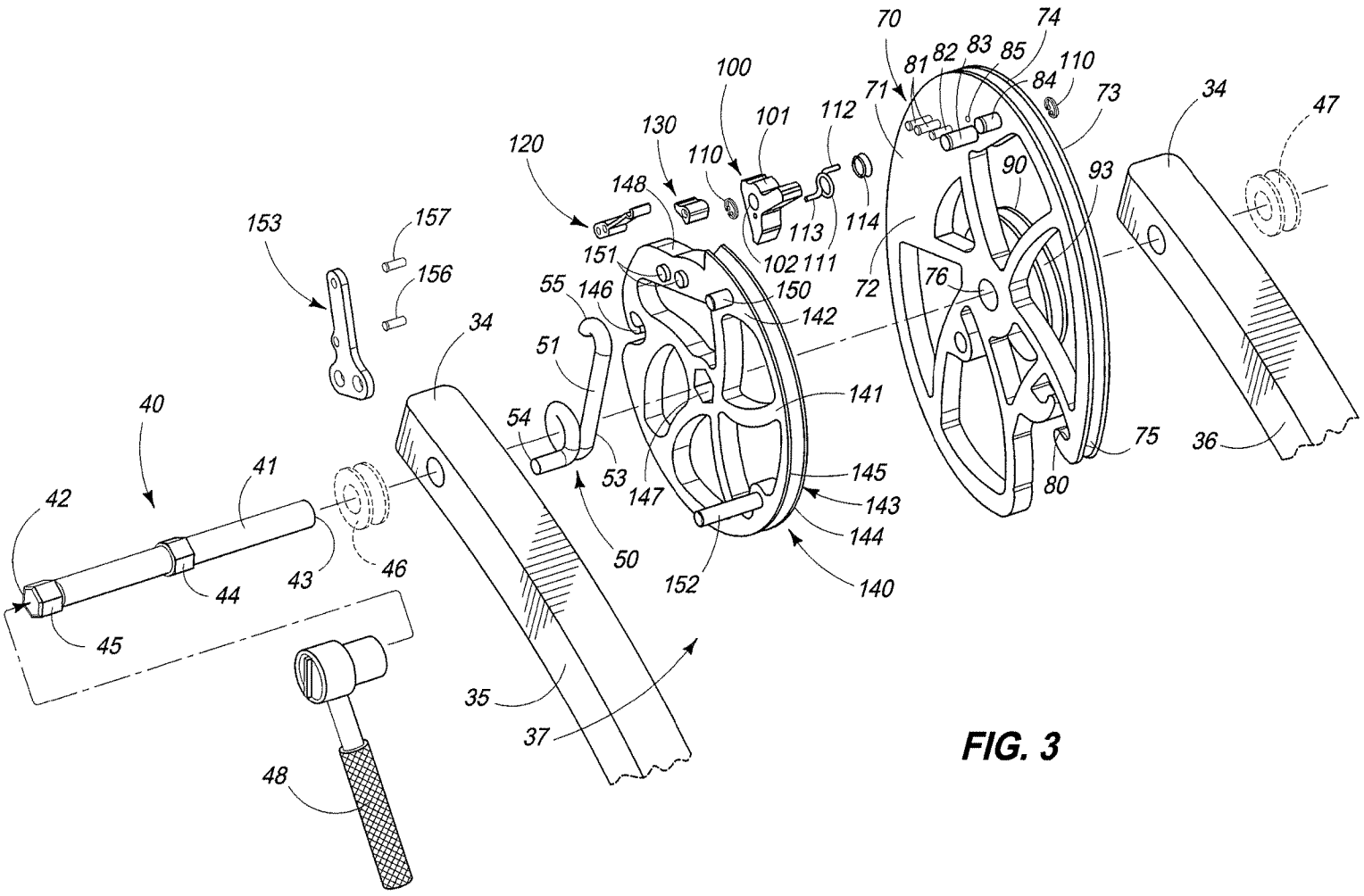
FIG. 3 is a fragmentary, exploded, perspective view of the first and second rotating members which are employed in first form of the present invention.
Figure 9:
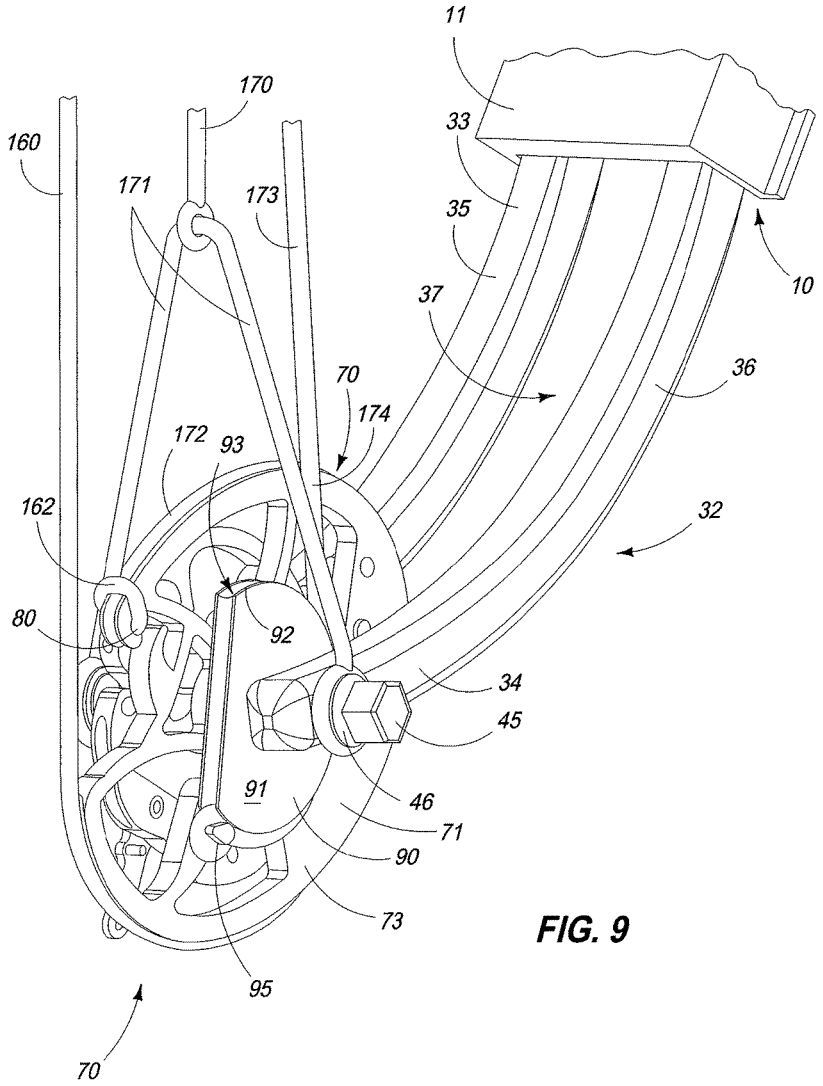
FIG. 9 is a perspective, side elevation view of the first and second rotating elements of the first form of the invention, and which is illustrated from a position opposite to that shown in FIG. 8.
Figure 10:
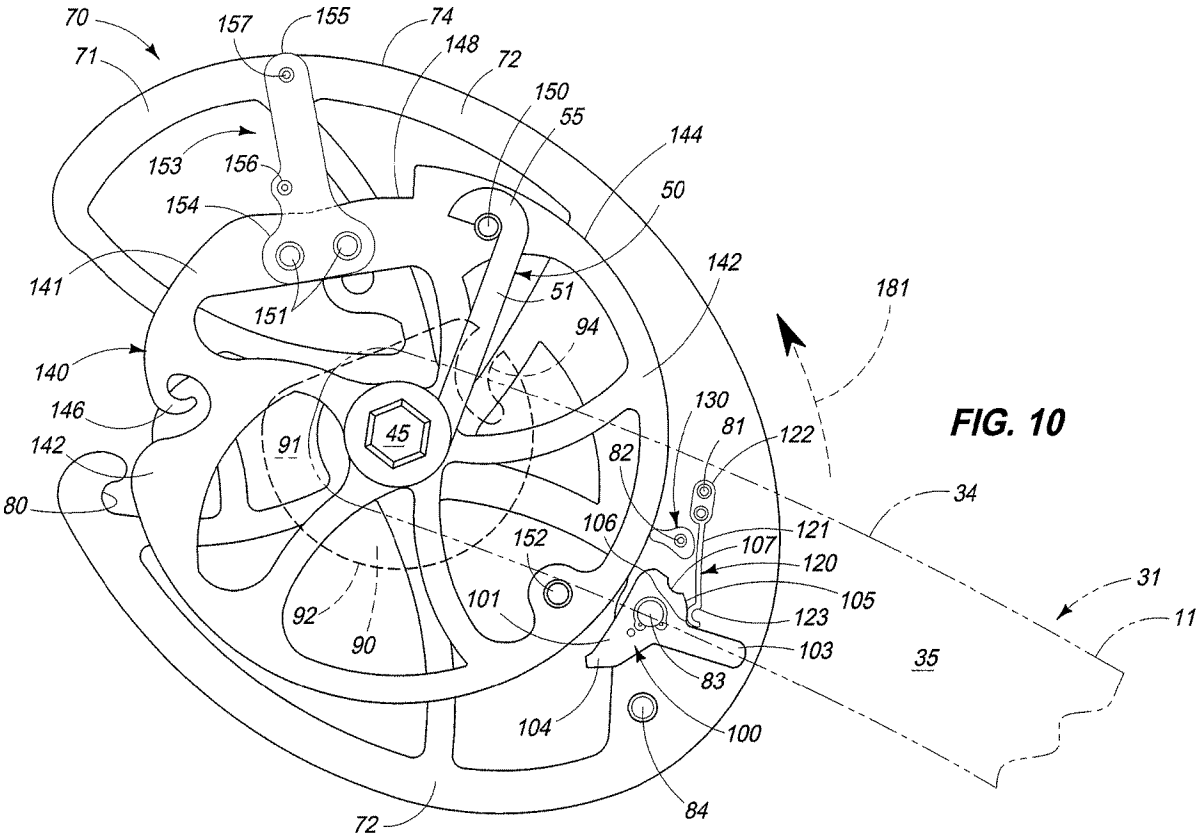
FIG. 10 shows a fragmentary, side elevation view of the first and second rotating members of the first form of the present invention, and which is shown moving in a first direction.
Figure 11:
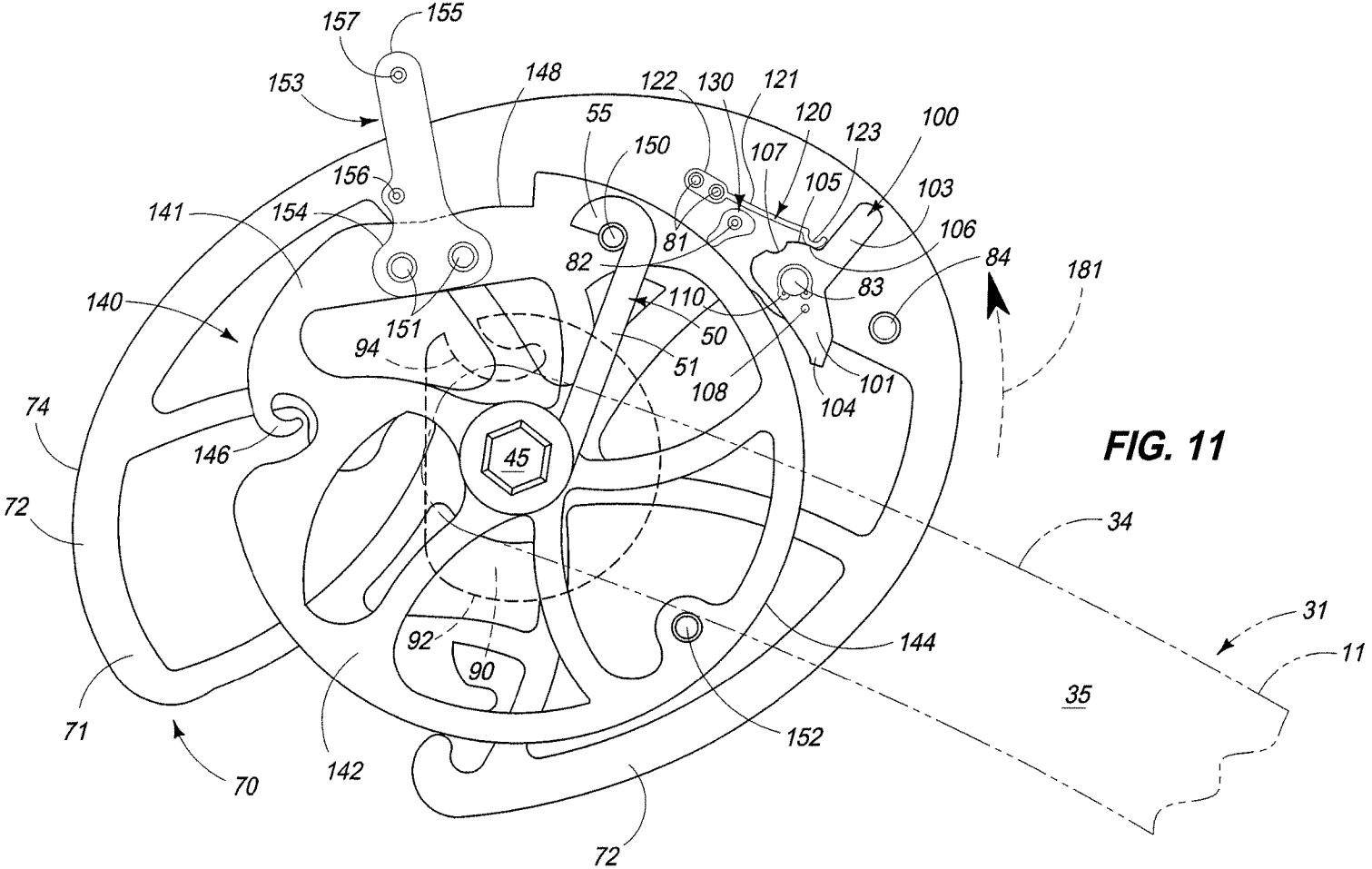
FIG. 11 is a later in time, fragmentary, side elevation view of the first and second rotating members of the first form of the present invention and which are shown moving in the first direction.
Figure 12:
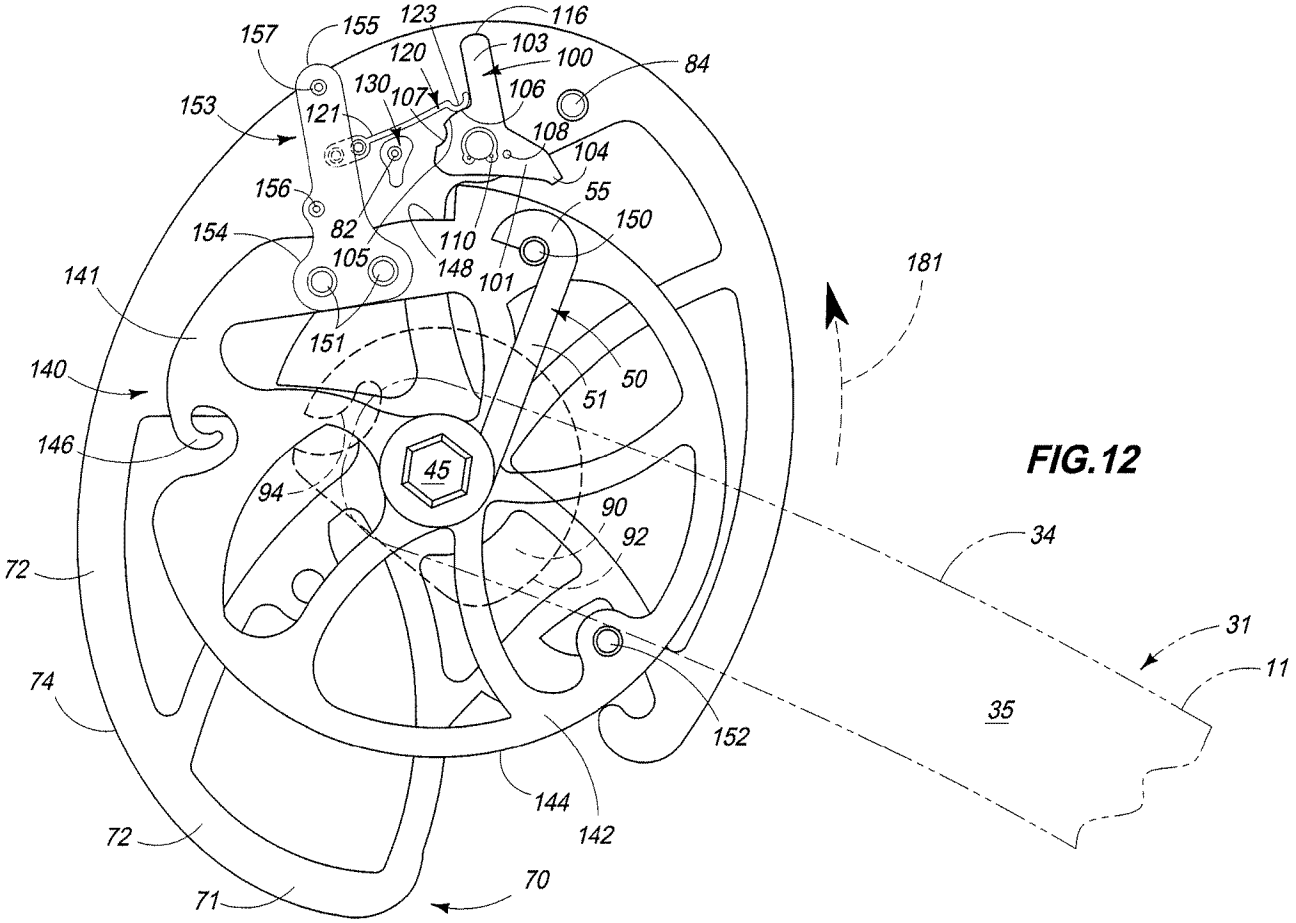
FIG. 12 is a still later in time, fragmentary, side elevation view of the first and second rotating members of the first form of the present invention while moving in the first direction.
Figure 13:
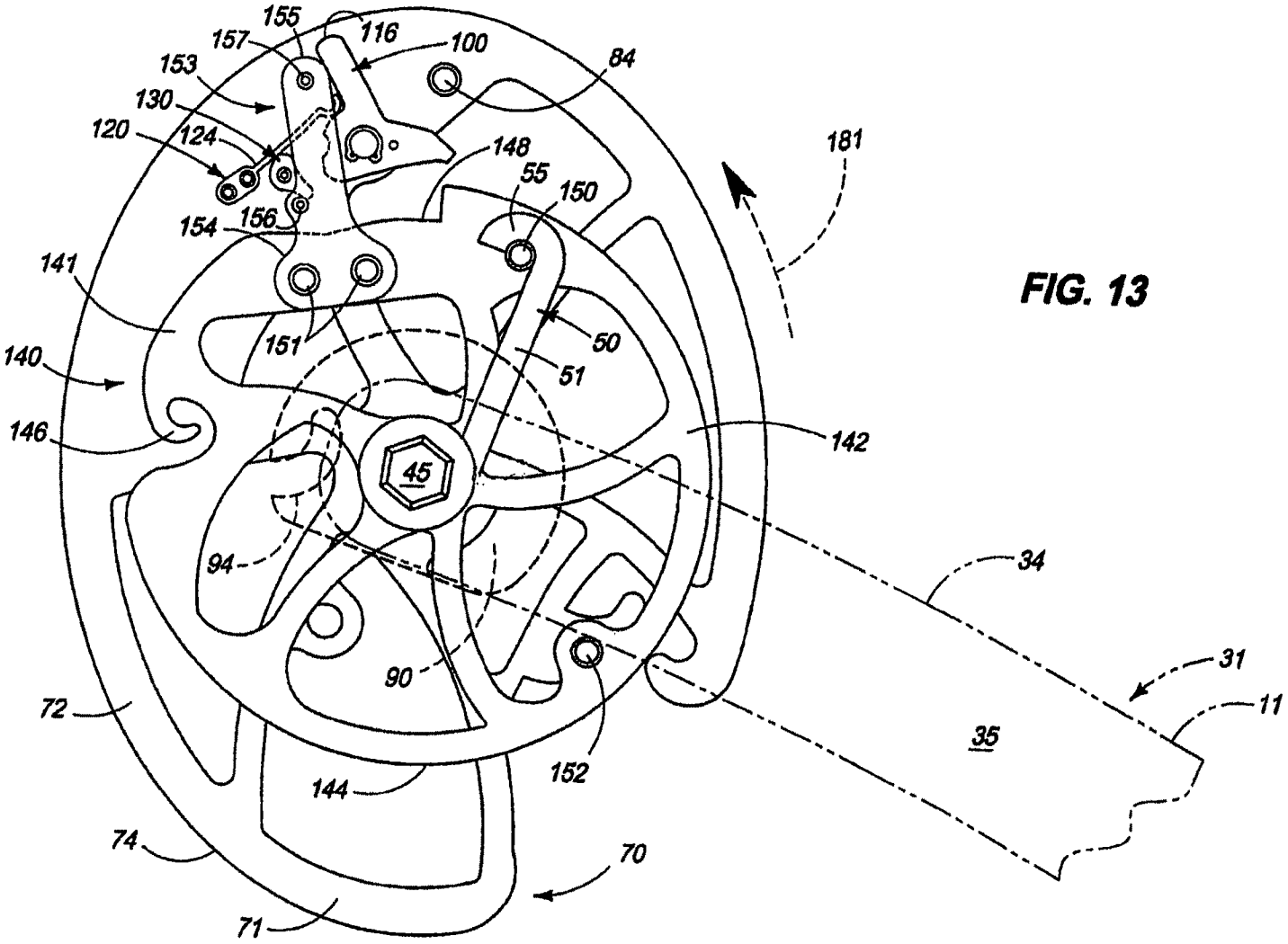
FIG. 13 is a still further, and later in time, fragmentary, side elevation view of the first and second rotating members of the first form of the invention while the first rotating member is moving in the first direction.
Figure 14:
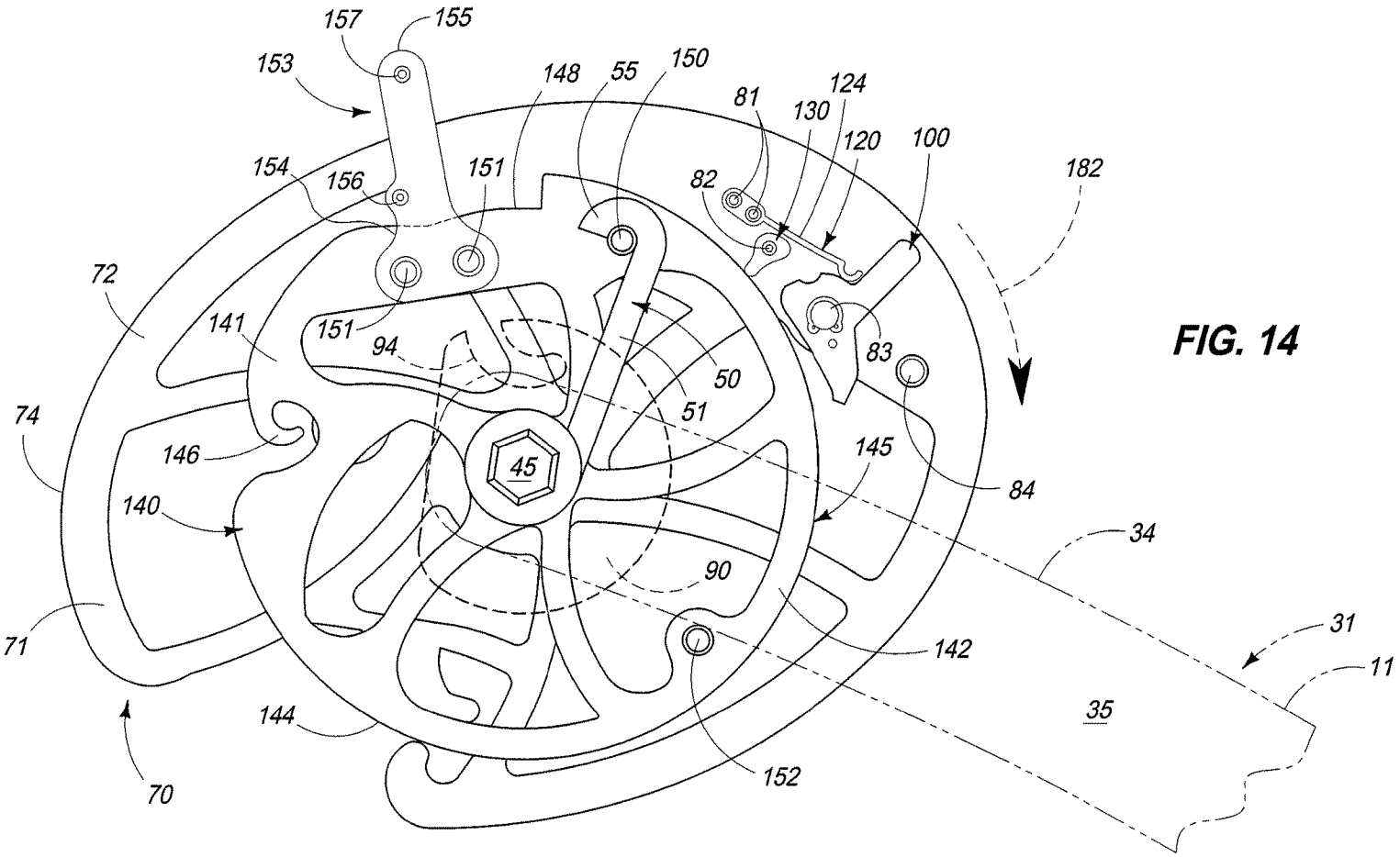
FIG. 14 is a subsequent, later in time, fragmentary, side elevation view of the first and second rotating members of the first form of the invention and which illustrates the first rotating member rotating in a second direction.
Figure 15:
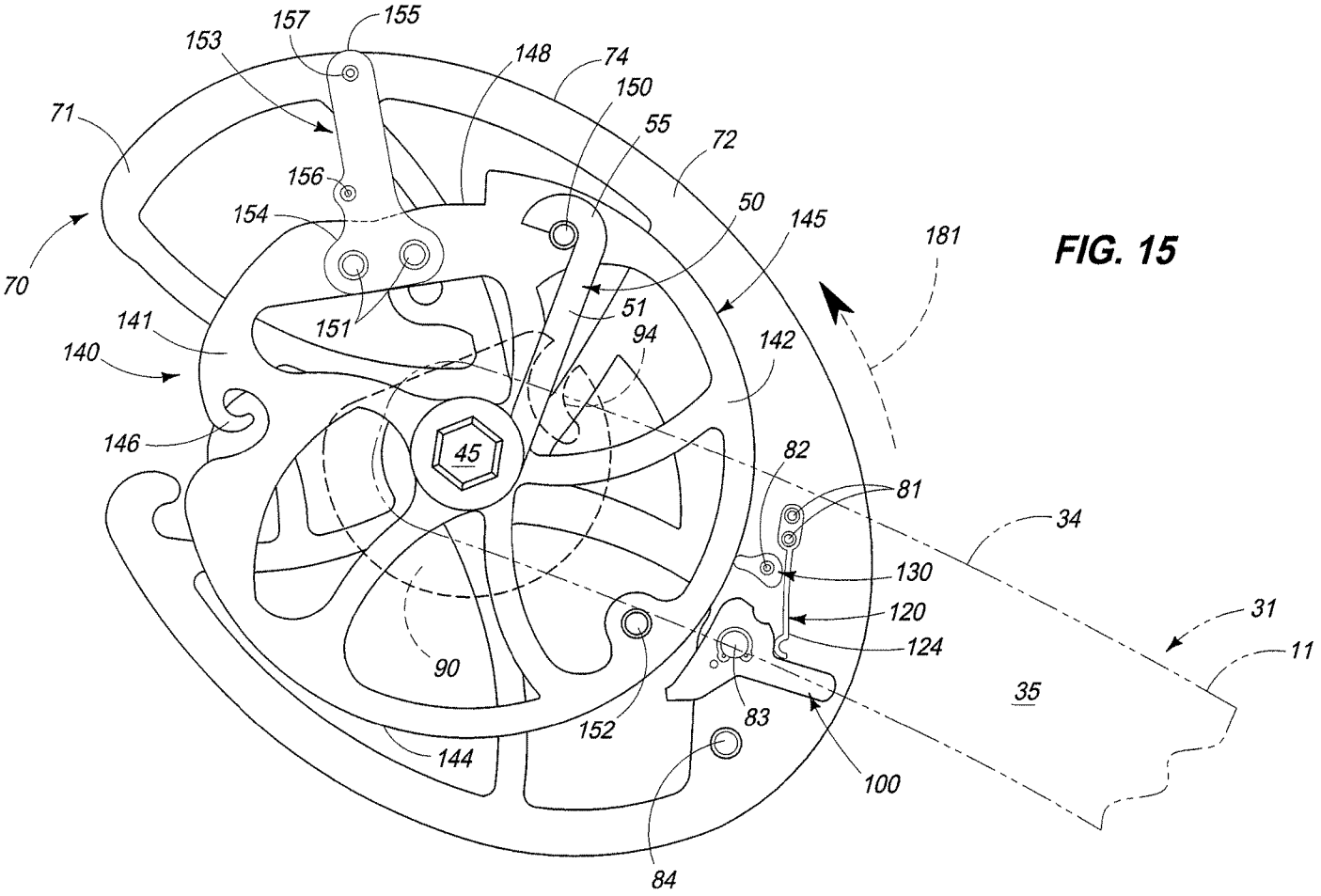
FIG. 15 is a later in time, fragmentary, side elevation view of the first and second rotating members of the first form of the invention and which illustrates the first rotating member rotating in the first direction.

The archery bow 10, as depicted, includes an axle 40, which is rotatably mounted on the distal end 34 of the first and second limbs 31 and 32, respectively, and which extends between the spaced, first and second forked members 35 and 36, respectively. The axle 40 has a main body 41, which has a first end 42, and an opposite, second end 43. Still further, and as illustrated in FIG. 3, a hexagonal intermediate portion 44 is formed on the main body 41, and is operable to be matingly received within and cooperate with, a second rotating member, as will be discussed in greater detail, below. Still further, a hexagonal end portion or member 45 is provided at the first end 42. Still further, a first pulley member 46, which is shown in phantom lines, is located between the hexagonal member 45 and the first fork member 35. Still further, a second pulley member 47 (which is also shown in phantom lines) is provided, and which is located between the second end 43, and the second fork member 36. These respective pulley members 46 and 47 cooperate with other string or cable members of the present archery bow 10, as will be discussed in greater detail, below. As should be understood, the arrangement of the respective invention components, as described, is substantially identical on the opposite ends of the archery bow as illustrated. In the case of the pulley members, 46 and 47, these structures are only found on the distal, second end 34, of the second limb 32, as seen in FIG. 9, and would not be utilized on the distal end 34 of the first limb, 31. As seen in FIG. 3, a tool 48 is provided, and which is operable to impart rotational movement to the axle 40 for the purposes which will be discussed in greater detail, hereinafter.

Figure 1A:
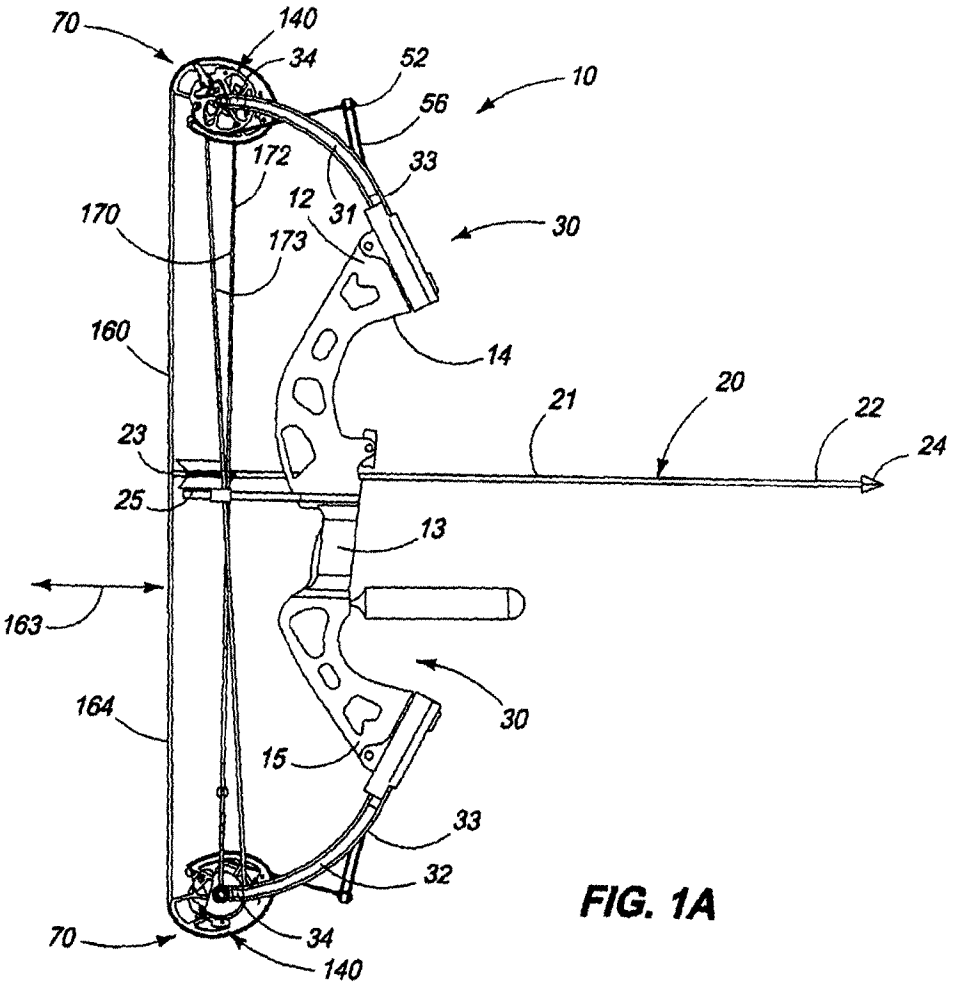
FIG. 1A is a side elevation view of a second form of the present invention and which shows an arrow in the first, at rest position.

The archery bow 10 of the present invention further includes a biasing member, which is generally indicated by the numeral 50. This biasing member has a first form which is generally indicated by the numeral 51, and a second form which is generally indicated by the numeral 52 (FIG. 1A). The first form 51 of the biasing member 50 has a main body 53 (FIG. 3), which is rotatably received, at least in part, on the axle 40, as seen in FIG. 3. Still further, the main body 53 has a first end 54, which engages the first forked member 35 of the first or second limb 31 or 32, respectively. Still further, the main body has a second end 55, which, in the drawings, is J or hooked shaped. The second end 55 is operable to forcibly engage the second rotating member as will be discussed in the paragraphs which follow. This biasing member 50, as seen in the first form 51, is depicted as a torsion spring and which, when rotated in a given direction, can provide a resistive or assistive biasing force, and which is useful in the operation of the present invention 10. Additionally, the biasing member has a second form 52, which includes a substantially planar and resilient main body 56, which is attached, or otherwise affixed to the handle 13, and which is further located between the first and second forked members 35 and 36, respectively. The main body 56 has a first end 57 which is attached to the handle 13, and a second, opposite, or distal end 58, which is located in the gap 37, and which is located between the first and second members 36 and 37, respectively. The operation of the second form 52 of the biasing member 50 will be discussed in greater detail, below. As seen in FIG. 1A, the second form 52 of the biasing member extends generally forwardly of the archery bow. However, another possible form of the invention includes a biasing member which extends rearwardly of the archery bow (not shown), and which, during operation, is operable to biasingly assist in the forcible propulsion of the arrow when released by an archer from the archery bow 10.

Figure 19:
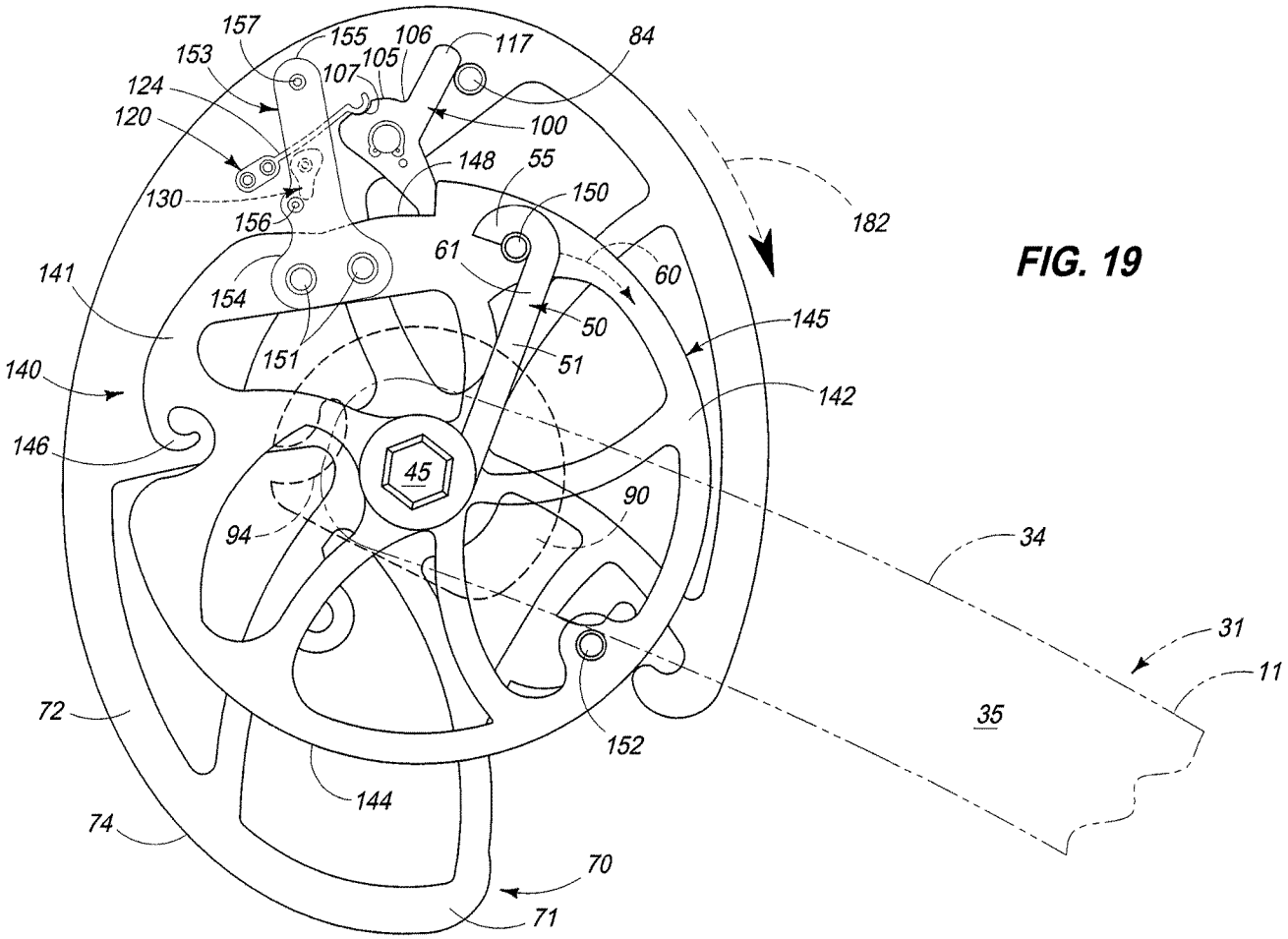
FIG. 19 is a later in time, fragmentary, side elevation view of the first and second rotating members of the present invention, and which illustrates the first rotating member forcibly engaging the second rotating member, and moving in the second direction.
Figure 21:
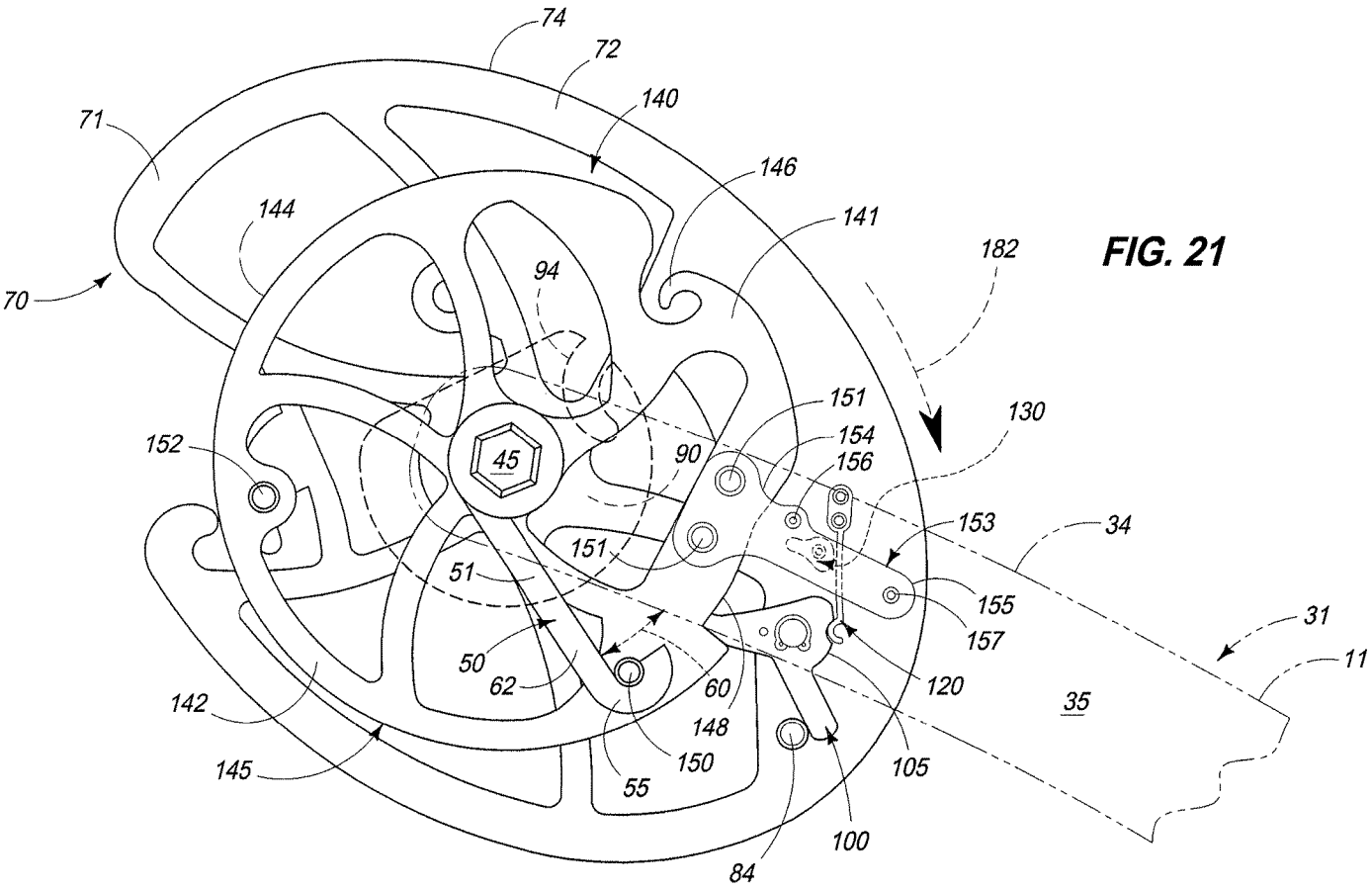
FIG. 21 is a later in time, fragmentary, side elevation view of the first and second rotating members of the present invention, and which illustrates the first rotating member forcibly engaging the second rotating member, and moving in the second direction.
Figure 26:
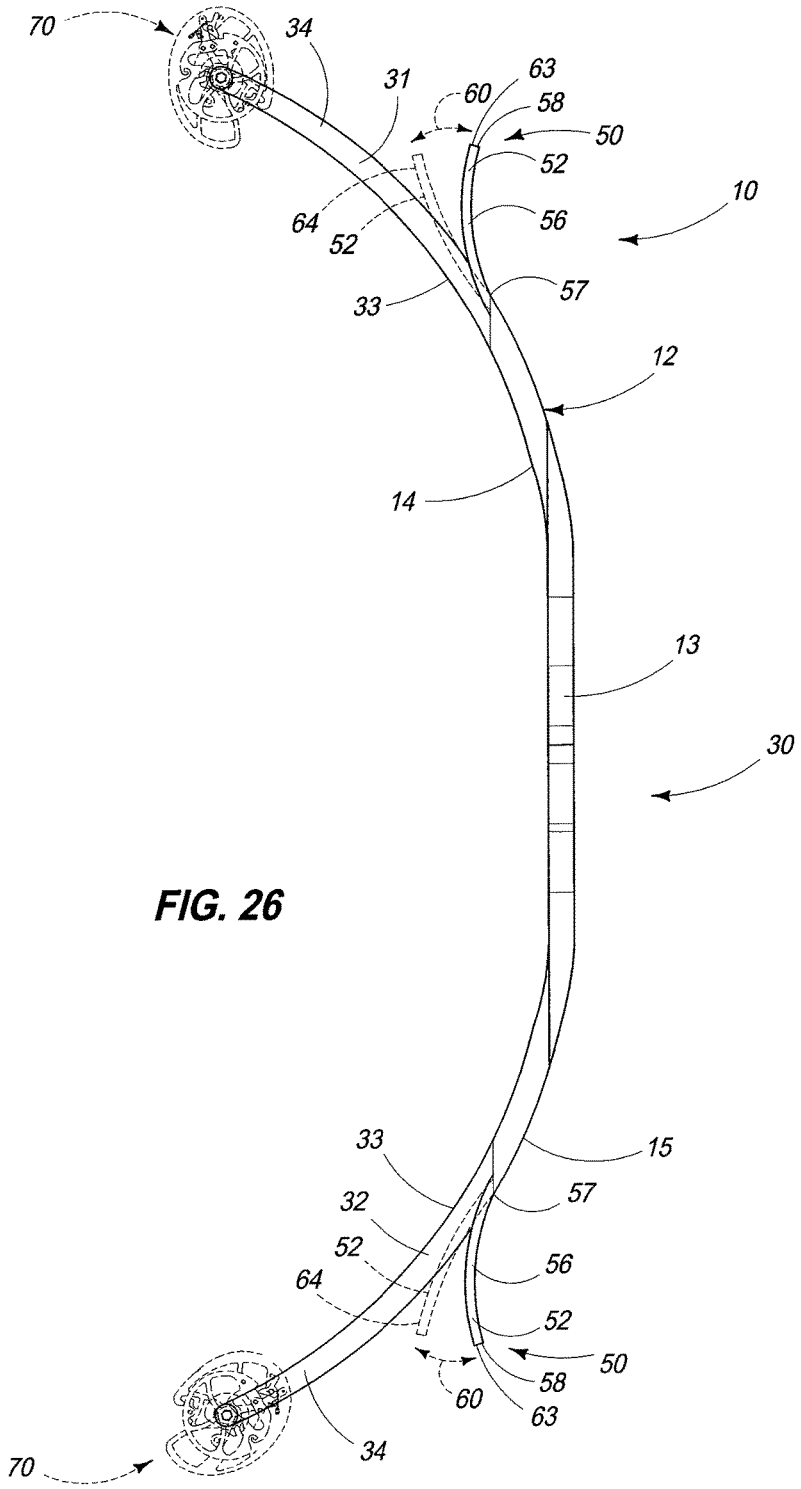
FIG. 26 is greatly simplified, side elevation view of a second form of the archery bow of the present invention.
Figure 27:
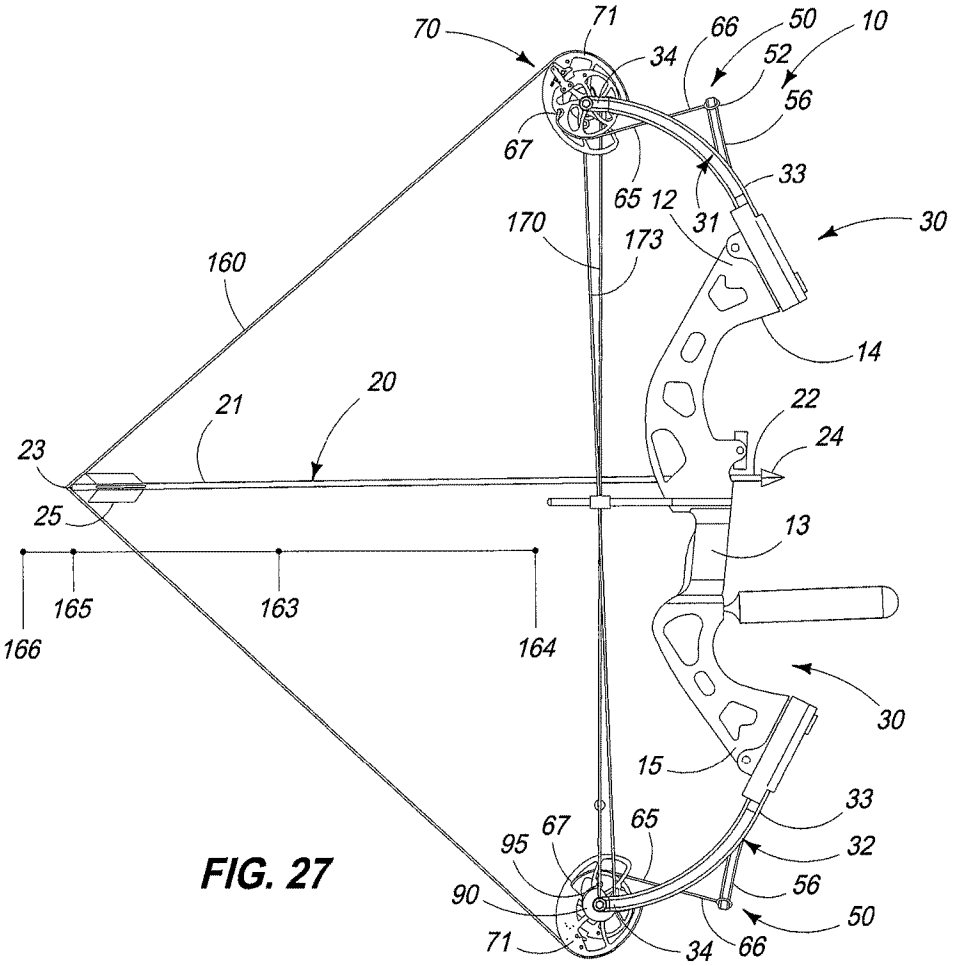
FIG. 27 is a second, side elevation view of the second form of the present invention, and which shows the string or cable in a second, arrow release position.
Figure 28:
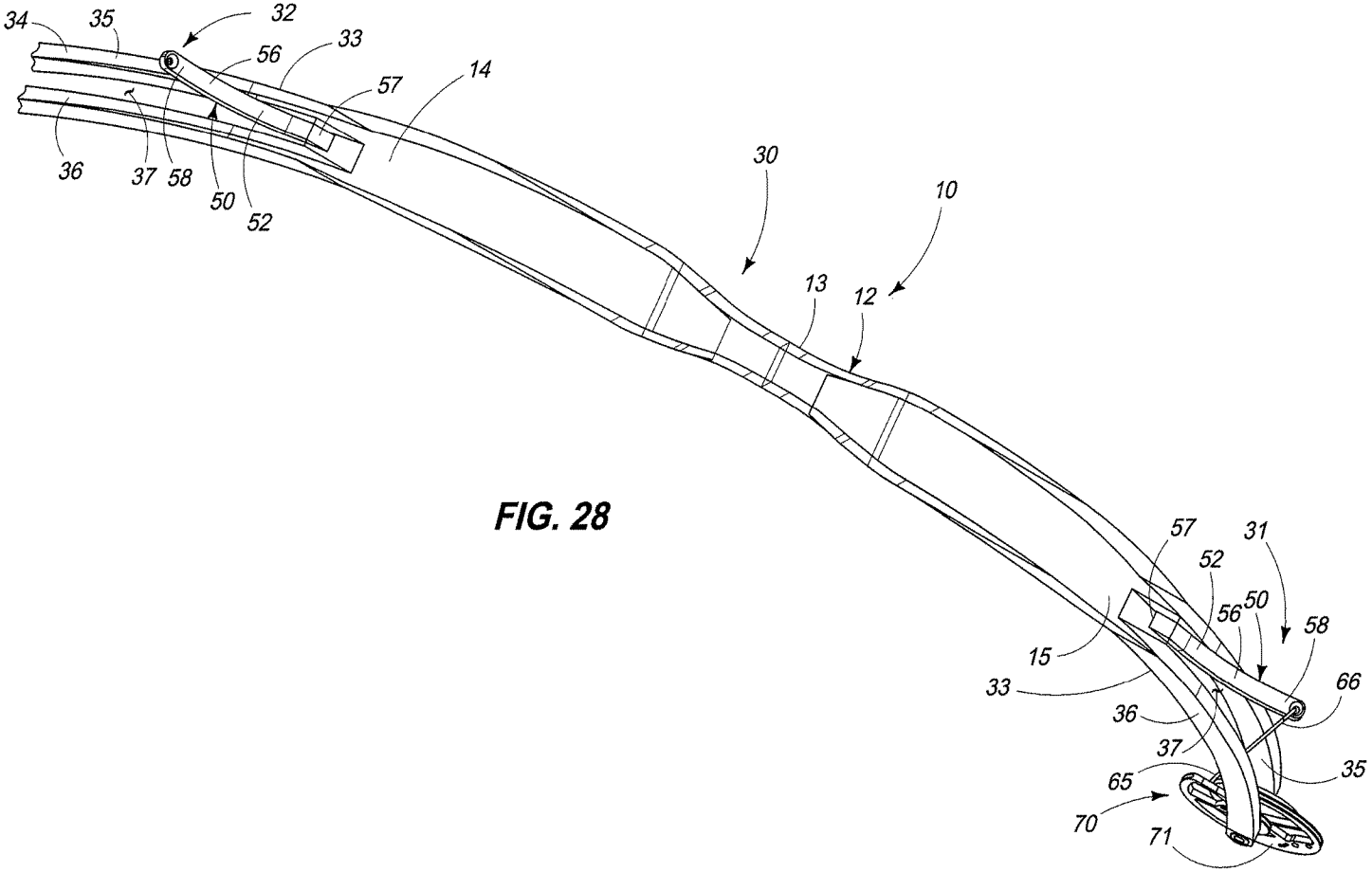
FIG. 28 is a perspective, partial, side elevation view of the second form of the invention, and with some structure removed to illustrate the structure thereunder.

As noted above, the biasing member 50, which is employed in the first and second forms of the invention 11 and 12, has a first and second form 51 and 52, respectively. The respective biasing members 50 move along a path of travel which is generally indicated by the numeral 60. In the first form of the invention 51, the second end 55 of the biasing member 50 is moveable from a first position 61, as seen in FIG. 19, to a second position 62, as seen in FIG. 21. Furthermore, with respect to the second form of the biasing assembly 52, it is moveable from a first position 63, as seen in FIG. 26 to a second position 64. As seen in the respective drawings, the second form 52, of the biasing member 50, further has a force transmitting member 65, which is attached thereto. The force transmitting member which is a flexible and elongated element, or cable, has a first end 66, which is attached to the second end 58 of the main body 56, and an opposite, second end 67, which is affixed to the second, rotating member as will be discussed in greater detail below.

The present invention, as described, includes, in both the first and second forms of the invention 11 and 12, a first rotating member which is generally indicated by numeral 70, and which is freely rotatably mounted on the axle 40, and which is located on the distal ends of 34 of the resilient main body 30, and between the first and second forked members 35 and 36, respectively. As will be appreciated, the axle 40 provides an axis of rotation for the first rotating member. The first rotating member has a main body 71, which has an eccentric shape, and further has a first surface 72, and an opposite second surface 73, which are individually disposed in substantially parallel, spaced relation, one relative to the other. The main body 71 is defined by a curved, peripheral edge 74, which has a channel 75 formed therein. Additionally, the first rotating member 70 has an axle channel or passageway 76 formed therein (FIG. 3), and which has a diametral dimension which is slightly greater than the main body 41 of the axle 40, and thereby permits the first rotating member 70 to freely rotate, thereabout, the axle member 40 in a manner which is described, below.

As seen in FIG. 3, it will be understood that the first rotating member 70 has formed therein a first string engagement notch 80, which is located near the peripheral edge 74, and which is operable to releasably secure a string, drawstring or cable for the archery bow 10, as will be described in greater detail, below. Still further, the first rotating member 70 further includes a pair of resilient restraining member posts 81, which are individually mounted in a predetermined position relative to the peripheral edge 74, and on the first surface 72. Further, and spaced from the respective resilient restraining member posts is a camming member post which is generally indicated by the numeral 82. Still further, mounted in spaced relationship relative to the caroming member post 82, and extending normally, outwardly, relative to the first surface 72, is a moveable pawl rotation post 83. Still further, and mounted in spaced relation relative to the movable pawl rotation post 83, is a pawl restraining post which is generally indicated by the numeral 84. The pawl restraining post is operable to engage a moveable pawl, as will be discussed in greater detail, below. Still further, and formed in the first surface 72 of the first rotating member 70 is a biasing member engagement aperture 85, which is operable to engage one end of a second biasing member, as will be described in greater detail, hereinafter.

Figure 2:
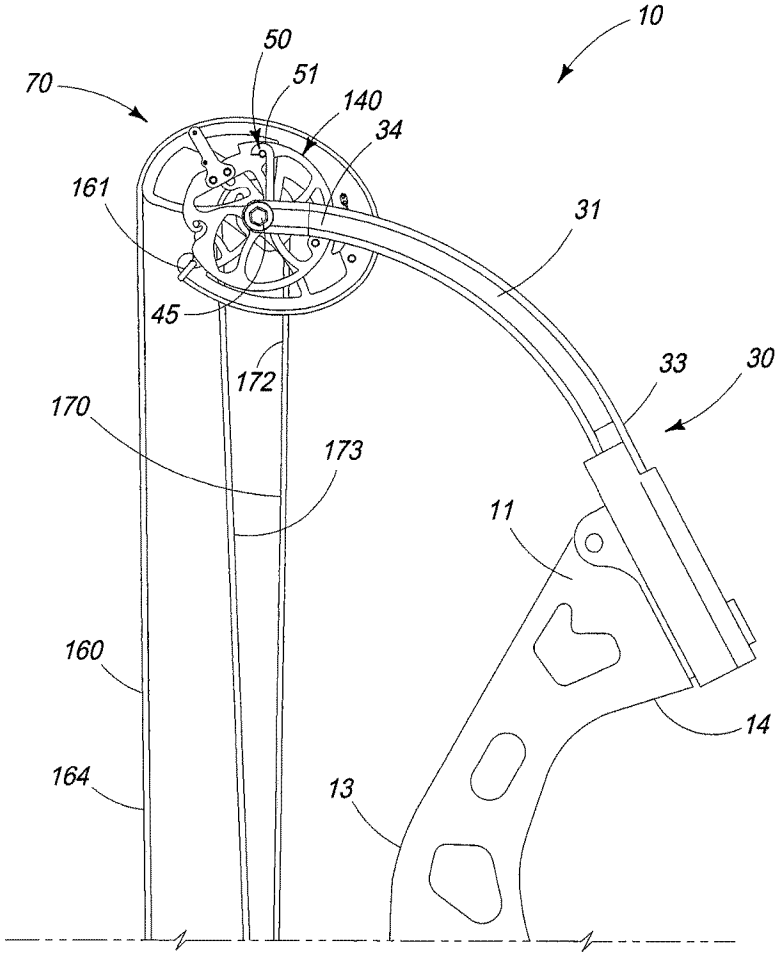
FIG. 2 is a fragmentary, side elevation view of the first form of the present invention, and illustrating first and second rotating members in a first, operational condition.
Figure 2A:
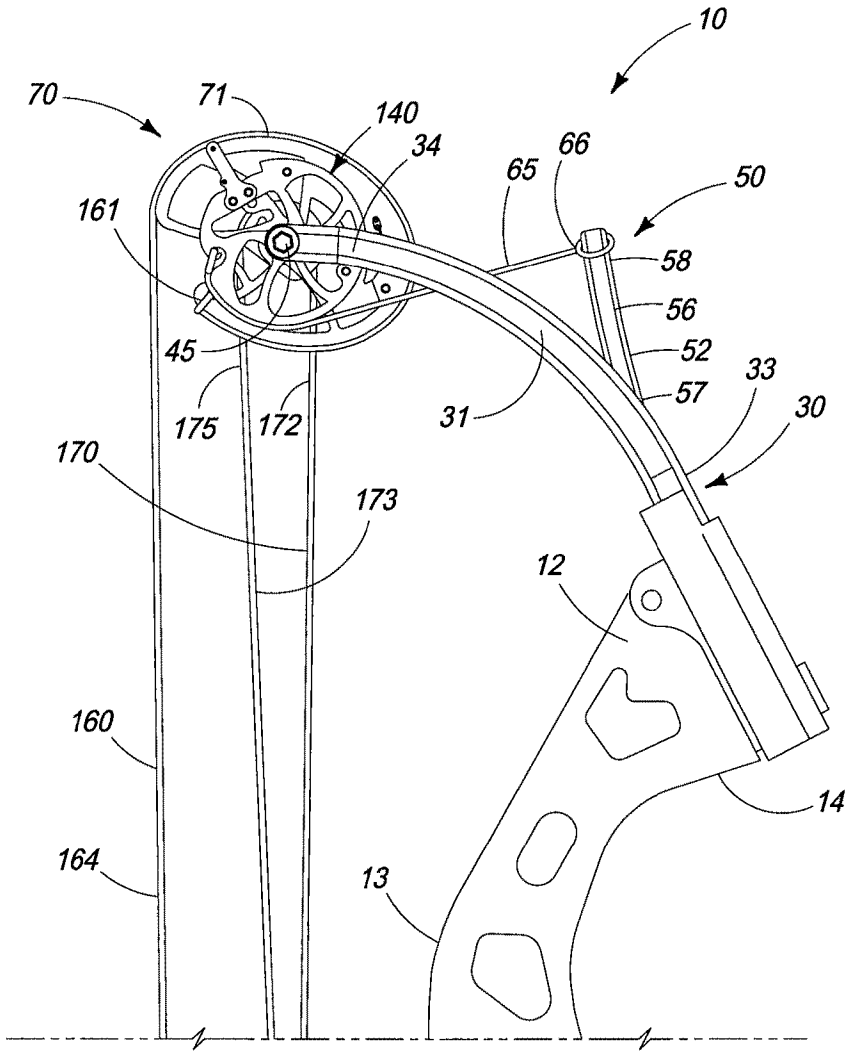
FIG. 2A is a fragmentary, side elevation view of the first and second rotating members of the second form of the invention, and which are shown in a first operational condition.
Figure 2B:
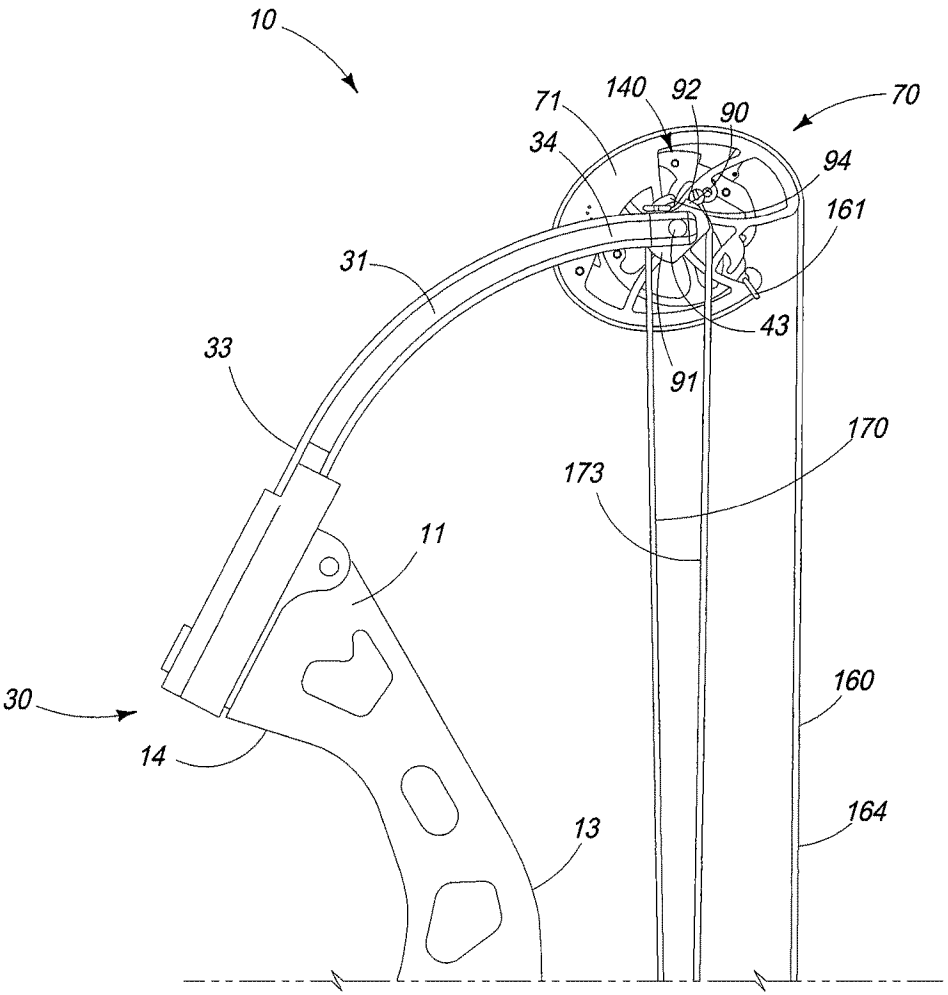
FIG. 2B is a fragmentary, side elevation view of the first form of the present invention, and which is taken from a position opposite to that seen in FIG. 2.

Referring now to FIG. 2B, it will be seen that the first rotating member 70, and more specifically, the second surface 73, thereof, mounts a cam member 90, which forcibly engages a second string or cable, which extends to one of the opposite limbs 31/32, as will be discussed, below. The cam member 90 has a main body 91, which is defined by a curved peripheral edge 92, and further has formed therein, a channel 93, which is dimensioned to receive a second cable or a string, and which extends, again, to the opposite distal end 34 of one of the first or second limbs 31 and 32, respectively (FIG. 3). Additionally, as will be seen in FIG. 2B, the cam member 90, which is located at the distal, second end 34 of the first limb 31 has main body 91 which has formed therein a string or cable engagement notch 94 for matingly engaging an appropriate second string or cable, as will be described, below. Further, the camming member 90, which is located at the distal, or second end 34 of the second limb 32, does not have the same string engagement notch 94 but rather has a string or cable engagement post 95 (FIG. 9) which is mounted on the second surface 73, and which further extends normally outwardly, thereof. This same structure (the post 95) also engages the distal end of another cable or string, which will be discussed, below.

Figure 3A:
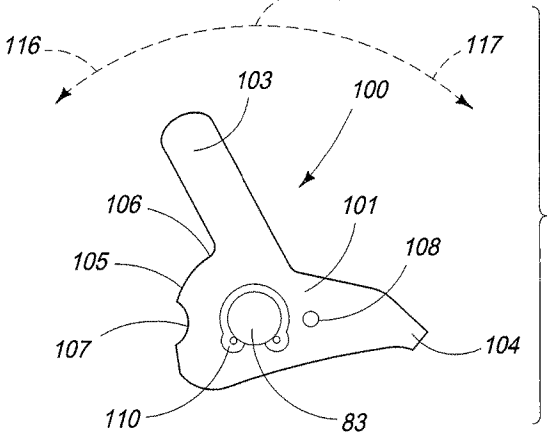
FIG. 3A is top plan view of a moveable pawl which forms a feature of the present invention.

The current invention 10 also includes, a moveable pawl 100, which is rotatably mounted on the first rotating member 70, and which further is defined by a main body 101 (FIG. 3A). The main body has a passageway 102 which is formed therein, and which is further operable to receive the moveable pawl rotation post 83, therethrough. Still further, the main body 101, of the pawl 100, includes a force transmitting portion or end 103, which extends laterally, outwardly, therefrom; an engagement member or portion 104, which also extends laterally, outwardly therefrom; and is further defined, at least in part, by a camming surface 105. The camming surface has a first end 106, and an opposite, second end 107. Still further, a spring engagement aperture 108 is formed in the main body 101, and is operable to engage one end of a second biasing member, which will be discussed in greater detail, below.

As best seen in FIG. 3, the moveable pawl 100 is rotatably secured on the pawl retaining post 83 by means of a retainer clip 110 of traditional design. Still further, and sandwiched or otherwise located between the moveable pawl 100, and the first surface 72, of the first rotatable member 70 is a second biasing member 111 (FIG. 3), here illustrated as a small, torsion spring. The second biasing member 111 has a first end 112, which is matingly received within the biasing member engagement 85 aperture, which is formed in the main body 71 of the first rotating member 70. Still further, the second biasing member 111 has a second end 113, which is matingly received within the spring engagement aperture 108 which is formed in the first surface 72. As illustrated in FIG. 3, a spacing member, or boss, 114, receives and otherwise supports the second biasing member 111 in spaced relation, and in a proper aligned orientation relative to the main body of 71 of the first rotating member 70. The pawl 100 is moveable along a path of travel 115 (FIG. 3A), between a first position 116, and a second position 117. The pawl 100 is moveable from the second position 117, and in the direction of the first position 116, under the biasing influence of the second biasing member 111, and in a fashion which will be described in greater detail in the operational phase of this application.

Figure 3B:
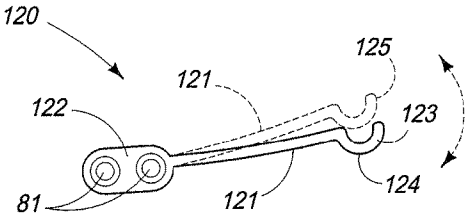
FIG. 3B is a side elevation view of a resilient restraining member which forms a feature of the present invention.
Figure 16:
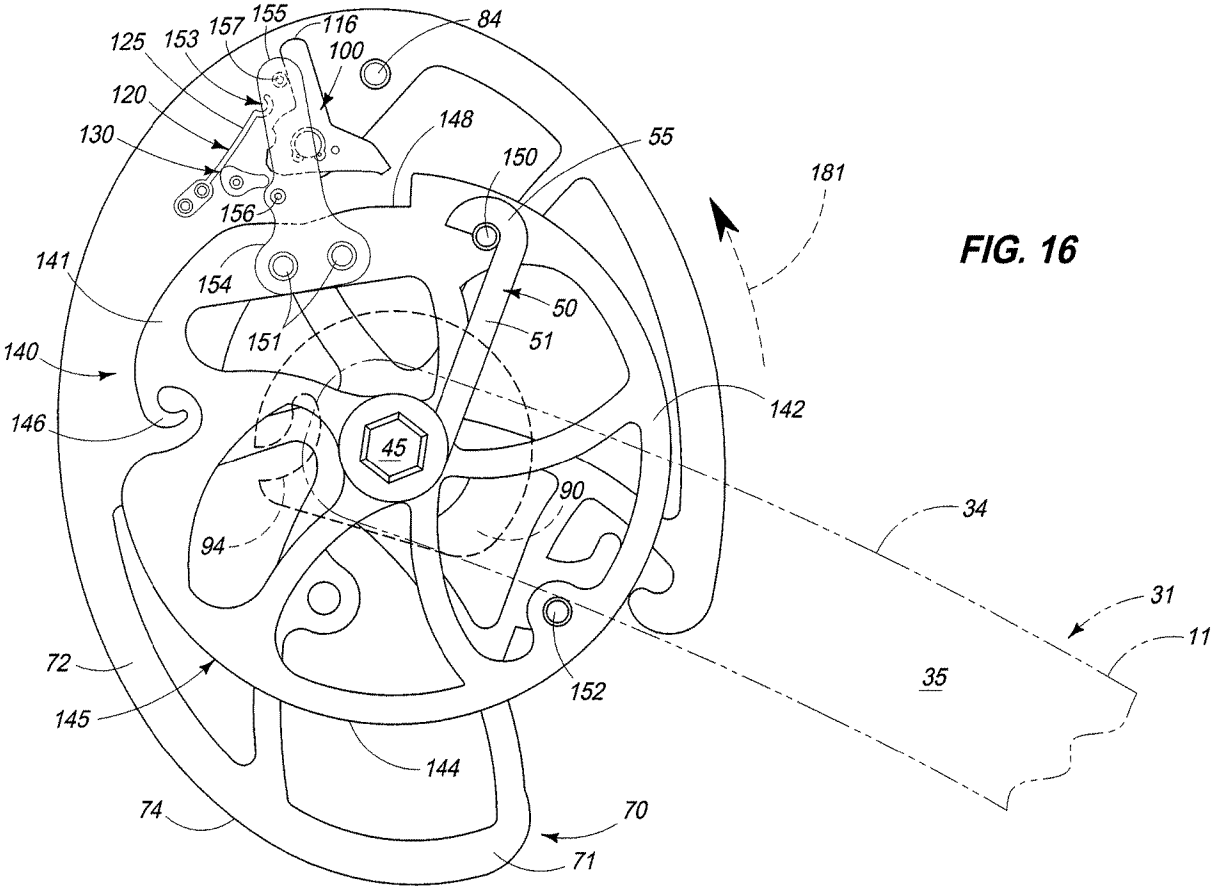
FIG. 16 is a later in time, fragmentary, side elevation view of the first and second rotating members of the first form of the invention, and which illustrates the first rotating member moving in the first direction.

The present invention 10 includes a resilient restraining member 120 (FIG. 3B), which is mounted on the first surface 72 of the first rotating member 70. The resilient restraining member 120 is operable to biasingly cooperate with the moveable pawl 100. The resilient restraining member has an elongated main body 121, which has a first end 122, and which is secured to the respective resilient restraining member posts 81, as earlier described. Additionally, the resilient restraining member 120 has an opposite, second or distal end 123, which is operable to forcibly engage the camming surface 105 of the moveable pawl 100 as it is moved between the first and second positions 116 and 117, respectively, and along the path of travel 115. The resilient restraining member 120 has a first, engaged position 124, as seen in the drawings, and a second, spaced position 125, whereby the second, distal end 123 is moved out of forcible engagement with the camming surface 105 of the moveable pawl 100 (FIG. 16). This movement of the resilient restraining member 120 between the first and second positions 124 and 125, respectively, will be discussed in greater detail, below.

Figure 3C:
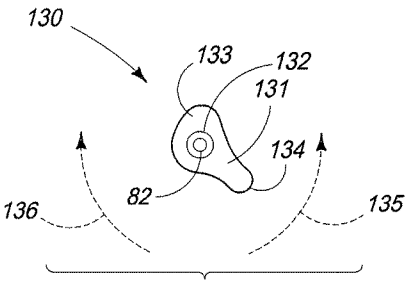
FIG. 3C is a top, plan view of a rotating cam which forms a feature of the present invention.

The present invention 10 also includes a rotating camming member 130 (FIG. 3C), and which is rotatably mounted on the first surface 72 of the first rotating member 70, and which is further received on, or about, the camming member post 82, and which extends normally, outwardly, relative to the first surface 72. The camming member 130 has a main body 131, which has a passageway 132 formed therein, and which receives the camming member post 82, therethrough. Still further, the rotating camming member 130 has a first end 133, and a second end 134, respectively. The camming member 131 is operable to rotate in a first direction 135, and in an opposite, second direction 136, when the caroming member is moved into contact with an engagement post which will be discussed in greater detail, hereinafter. Upon rotation of the main body 131, as will be described, hereinafter, the rotating camming member forcibly engages the resilient restraining member 120, and thereby urges the resilient restraining member out of forcible engagement 124 with the moveable pawl 100, and which further places it in the second, spaced position 125. In the second, spaced position 125, the moveable pawl is operable to move along the path of travel 115, from the first position 116, to the second position 117, to accomplish one of the operational aspects of the present invention 10, as will be described, in greater detail, in this application.

Figure 29:
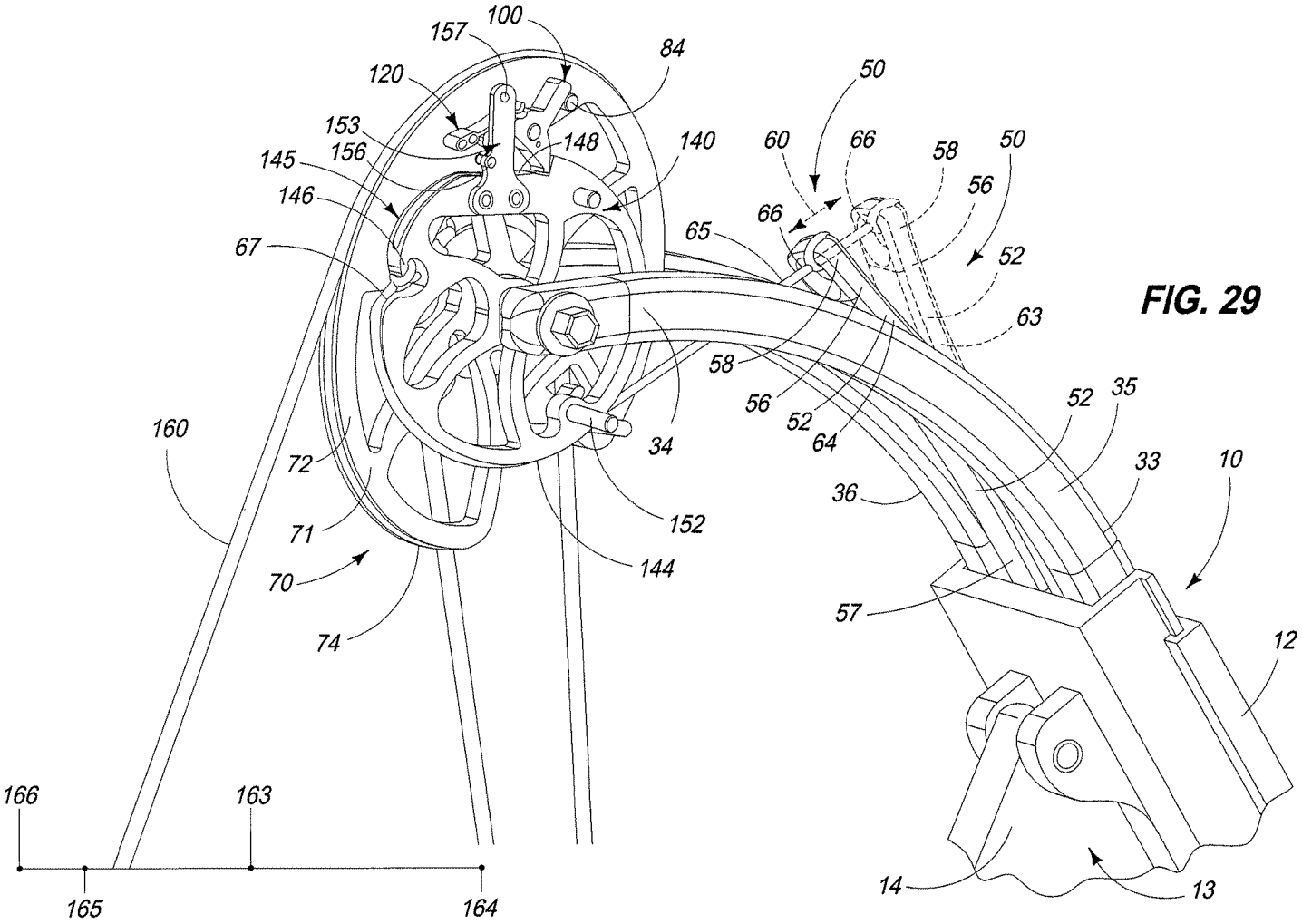
FIG. 29 is a greatly enlarged, perspective, side elevation view which illustrates the position of the first and second rotating members during a predetermined time in the operation of the second form of the archery bow.

Referring now to FIG. 3, it will be seen that the present invention 10 includes a second rotating member which is generally indicated by the numeral 140, and which is further located in closely adjacent, spaced, juxtaposed relation relative to the first rotating member 70. The second rotating member 140 is selectably, forcibly, co-rotatable with the first rotating member 70 about the same axis, as defined by the axle 40, and in a manner which will be described, below. The second rotating member 140 has a main body 141 which is generally semi-circular in shape, and which further has a first surface 142, and an opposite, second surface 143. Still further, the main body is defined by a peripheral edge 144. Additionally, a channel 145 of given dimensions is formed in the peripheral edge (FIG. 29), and which is operable to matingly receive, and cooperate with, the force transmitting member 65, as used in the second form of the invention 12, as will be discussed, below. As seen in the drawings, the second rotating member 140 has a string or cable engagement notch 146 which is formed in a location which is adjacent to the peripheral edge, and which engages the second end 67 of the force transmitting member 65 in the manner which will be described. Additionally as seen in FIG. 3, a hexagonally shaped passageway 147 is formed therethrough the main body 141, and which is operable to matingly cooperate with the hexagonal intermediate portion 44, and which is made integral with the axle 40. As such, it will be recognized that the second rotating member 140 is operable to co-rotate with the axle 40, and further is selectably forcibly co-rotatable with the first rotating member 140 by engagement with the pawl 100, and in the fashion which will be described, below. As seen in the drawings, the second rotating member 140 defines an engagement notch, or region 148, which is located along the peripheral edge 144. By utilizing this particular arrangement, the pawl 100 is operable to selectively, forcibly cooperate with the second rotating member 140, by being received in the engagement notch 148 during the operation of the invention 10, so as to effect the forcible assistive and/or resistive co-rotation of the first and second rotating members, 70 and 140, respectively, during the operation of the archery bow 10.

Figure 3D:
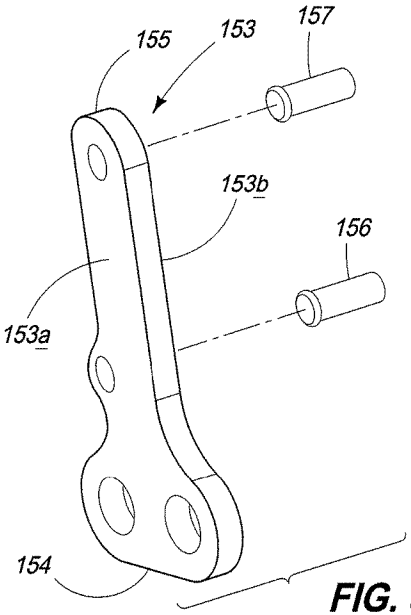
FIG. 3D is a perspective, side elevation view of a support member, which forms a feature of the present invention.

Referring still to FIG. 3, the present invention 10 includes a biasing spring engagement post 150, which extends normally, outwardly, relative to the first surface 142, and which is operable to be engaged by the biasing spring 50 which is employed in the first form of the invention 11. Still further, and mounted on the first surface 142, are a pair of support member engagement posts 151; and a rotation restraining post 152, which respectively extend normally, outwardly, relative to the first surface, and which are individually positioned in predetermined locations adjacent to the peripheral edge 144. The rotation restraining post 152 impairs or otherwise restricts the rotation of the second rotatable member 140 in a given first direction (FIG. 16) in a fashion which will be described during the operation of the present invention 10. Additionally, and mounted on the pair of support member engagement posts 151 is a substantially planar support member 153 (FIG. 3D), and which extends generally, laterally, outwardly relative to the peripheral edge 144 of the main body 141. The support member 153 has top and bottom surfaces 153A and B, respectively, and further has a first end 154, which is affixed in the nature of a friction-fit, or other suitable fastening means, to the pair of support member engagement posts 151, and an opposite distal second end 155. Mounted on the second end 155, are first and second engagement posts 156 and 157, respectively, and which are spaced from each other, and which further extend in the direction of, but do not engage the first rotating member 70. The respective engagement posts matingly cooperate with the moveable pawl 100, and the rotating cam member 130 in order to effect the appropriate movement of the moveable pawl along the previously described path of travel 115 to achieve several objectives of the present invention 10.

Figure 8:
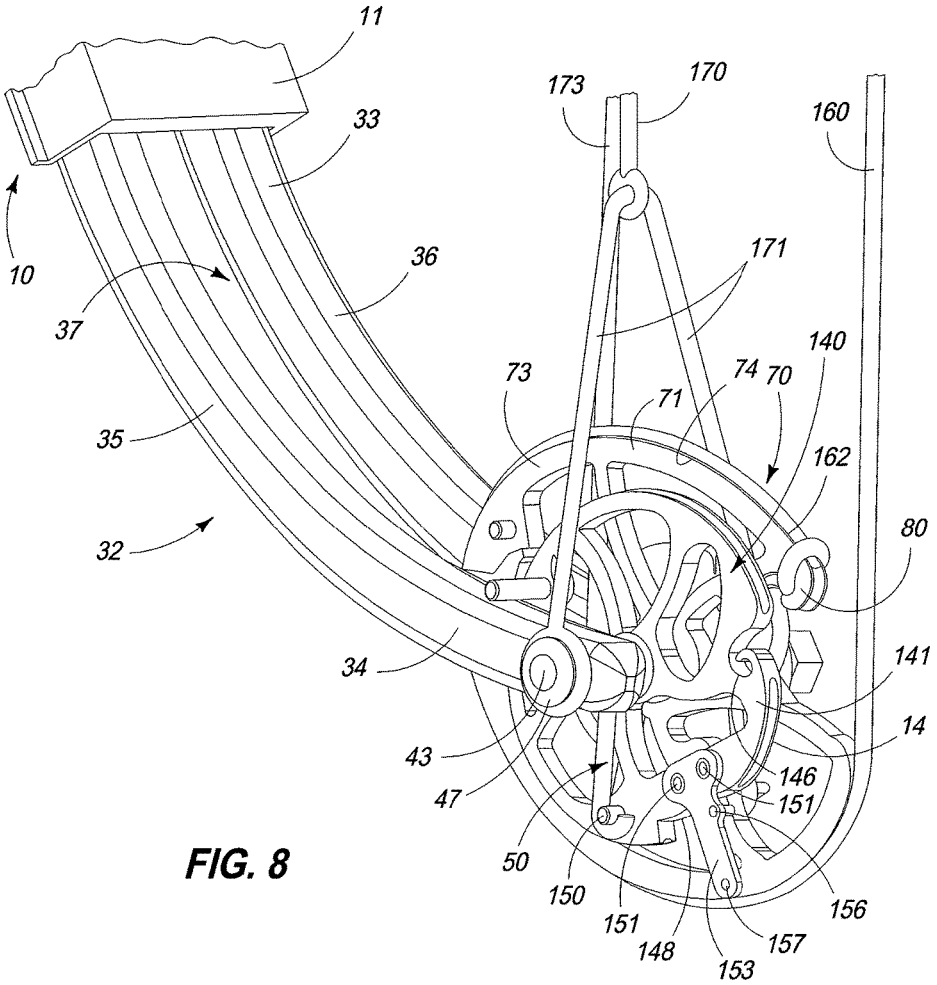
FIG. 8 is a perspective, side elevation view of the first form of the present invention, and which illustrates, the first and second rotating members which are located on the opposite end of the archery bow as depicted in FIGS. 1-7.

The present invention includes an arrow engagement string, drawstring or cable, and which is generally indicated by the numeral 160. This structure may periodically be referred to as merely, a string, however, it is the same structure. The arrow engagement, drawstring or cable 160 is of traditional design, and has a first end 161, which is received in, and otherwise engages the first string engagement notch 80, and which is formed in the main body 71 of the first rotating member 70. Still further the arrow drawstring or cable 160 has a second end 162, which is received about the peripheral edge 74, and in the channel 75 of the opposite, first rotating member 70, and which is located on the opposite limb of the archery bow 10 (FIG. 8). Again, the second end 162 is received in the corresponding string engagement notch 80, which is formed in the first rotating member 70, and which is located on the opposite limb. In the archery bow 10 arrangement as seen in the drawings, the archery bow, as earlier described, has a resilient main body 30, having opposite distal ends 34. Further, a biasing member 50, as seen in the drawings, is borne by the main body 30, and further, the arrow engagement, string, drawstring or cable extends, and is tensioned between the distal ends of 34, and wherein the string, or drawstring, 160, has a path of movement 163, which is defined between a first, at rest position 164; a second, arrow release position 165; and a third, string return position 166. The biasing members 50, as earlier described, biasingly resists the movement of the arrow engagement drawstring or cable 160 from the third, string return position, to the first, at rest position; and additionally biasingly assists in the movement of the arrow engagement string or cable 160 from the first, at rest position 164, to the second, arrow release position 165, in a manner which will be described in the operational phase of the present application.

In addition to the first arrow engagement string, drawstring or cable 160, the present archery bow 10 further has a first limb engagement cable which is generally indicated by the numeral 170. As seen in the drawings, the first limb engagement cable is defined, in part, by a first yoke 171, which engages the opposite sides of the second limb 32, and which further engages the distal end of the axle 40 by means of the first and second pulleys, 46 and 47 respectively (FIG. 8). Further, the first limb engagement cable has a second, distal end 172, which is operable to engage the cam member 90, and which is located on the opposite limb 31. The distal end 172 engages the notch 94. Still further, the present archery bow 10 has a second limb engagement cable 173, which has a first end 174, and which, again, engages the opposite cam member 90, and is received about, and secured to the post 95, which is located on the second limb 32. Again, this second limb engagement cable extends upwardly, and has a second end 175, which again engages the cam member 90, which is located on the first limb 32 and is received about the cam member 90 and is secured to the post 95 which is located adjacent thereto.

Operation

The operation of the described embodiments 11 and 12, of the present invention 10, are believed to be readily apparent, and are described in further detail, below, and by reference to FIG. 1, and following.

In its broadest aspect, the present invention relates to an archery bow 10, which includes a resilient main body 30 having opposite, distal ends 34, and a biasing member 51/52, which is borne by the main body 30. In its broadest aspect, the archery bow 10 also includes a string 160, which extends, and is tensioned between, the distal ends 34 of the main body 30. The string, drawstring or cable 160 has a first, at rest position 164; a second, arrow release position 165; and a third, string return position 166. The biasing member 51/52 biasingly resists the movement of the string 160 from the third, string return position 166, to the first, at rest position 164. Further, as presently conceived, the respective biasing members 50 are also operable to biasingly assist in the movement of the string 160 from the first, at rest position 164, to the second, arrow release position 165. In this regard, and when the string 160 is located in the second, arrow release position 165, the string is located at a predetermined, first distance from the first, at rest position 164. Further, the third, string return position 166 is located at a predetermined, second distance, from the first, at rest position 164. This second distance is greater than the first distance. As seen in drawings, the biasing member 51, in the first form of the invention 11 comprises, at least in part, a torsion spring.

Further, in the second form 12 of the invention 10, the biasing member 52 comprises a planar biasing member (FIG. 29), and which is located near at least one of the distal ends 34 of the main body 30, and which is affixed to the handle 13.

The archery bow 10, as described, includes a first rotating member 70 which is mounted on at least one of the distal ends 34 of the main body 30. As illustrated, the string 160 forcibly engages the first rotating member 70. Further, the archery bow 10 includes a second rotating member 140, which is mounted on at least one of the distal ends 34 of the main body 30, and which is further located in spaced, substantially parallel relationship relative to the first rotating member 70. The second rotating member 140 is further, selectively co-rotatable with the first rotating member in opposite first and second directions 181 and 182, respectively. As earlier noted, the biasing member 51/52 biasingly cooperates with the second rotating member 140. In this regard, the first and the second rotating members 70 and 140, respectively, co-rotate together in the second direction 182 when the string 160 moves from the third, string return position 166 to the first, at rest position 164. Additionally, the second rotating member 140 is individually rotatably moveable in the second direction 182 relative to the first rotating member 70 when a tool 48 applies rotation to the axle 40. When this event occurs, the second rotating member 140 moves to a position where the pawl 100 forcibly engages the second rotating member 140 (FIG. 21). Therefore, subsequent movement of the string 160 from the first, at rest, position 164 to the second, arrow release position 165, is then biasingly or forcibly assisted by the co-rotation of the first and second rotating members 70, in the first direction 181. This feature of the invention allows an archer a convenient means by which they can utilize and draw an archery bow having much greater power than what they could physically draw and handle, heretofore, because the biasing member forcibly assists the archer in moving or drawing the string 160 from the first, at rest position, 164, toward the second, arrow release position 165.

Figure 17:
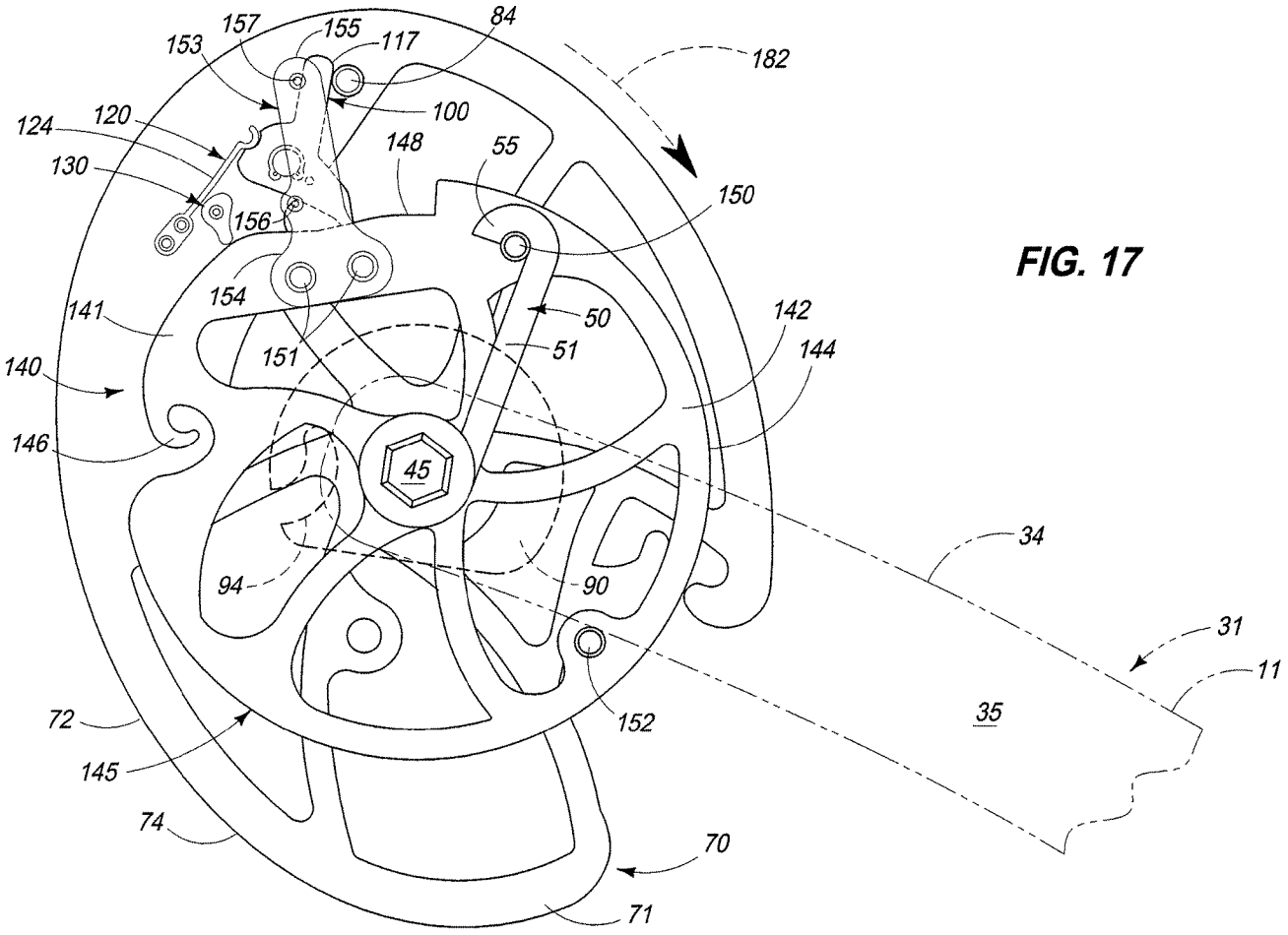
FIG. 17 is a later in time, fragmentary, side elevation view of the first and second rotating members of the present invention, and which illustrates the first rotating member forcibly engaging the second rotating member, and moving in the second direction.

The archery bow 10 of the present invention has, as earlier described, a moveable pawl 100 which is borne by the first rotating member 70, and which is operable to move along a path of travel 115, from the first position 116 (FIG. 16), where the movable pawl 100 is spaced from the second rotating member 140, to a second position 117 (FIGS. 17, 18 and 19), where the movable pawl 100 forcibly engages or matingly cooperates with the second rotating member 140 so as to cause the first and second rotating members 70/140 to selectively co-rotate together in the first or second directions 181 and 182, respectively, during the operation of this novel archery bow 10. As illustrated, and during co-rotation of the first and second rotating members 70/140 in the first direction 181, the first biasing member 51/52 biasingly or forcibly assists in the co-rotation of the first and second rotating members 70/140; and further biasingly or forcibly resists the movement of the string 160 from the third, string return position 166, to the first, at rest position 164 when the first and second rotating members 70 and 140, respectively are co-rotating together in the second direction, 182.

Figure 18:
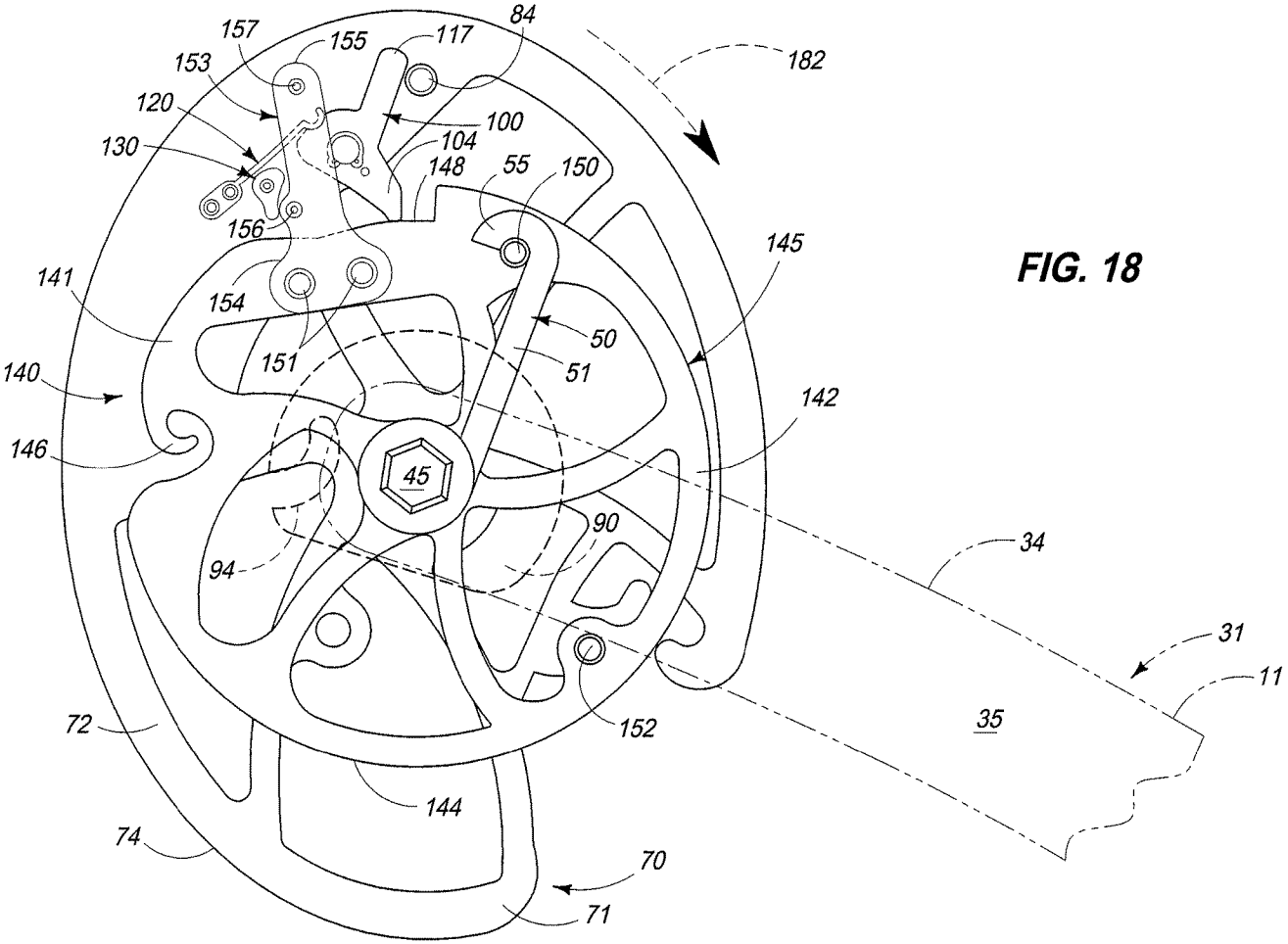
FIG. 18 is a later in time, fragmentary, side elevation view of the first and second rotating members of the present invention and which illustrates the first rotating member forcibly engaging the second rotating member, and moving in the second direction.

The archery bow 10 of the present invention further includes a resilient restraining member 120 which is borne by the first rotating member 70, and which engages the moveable pawl 100. The resilient restraining member 120 resiliently restrains the moveable pawl 100 in either the first position 116 (FIG. 16), or the second position 117 (FIG. 18). Additionally, the moveable pawl 100, as illustrated, is rotatably mounted on the first rotating member 70, and further includes an engagement member 104; a force transmitting portion 103; and a camming surface 105. The resilient restraining member 120 forcibly engages the camming surface 105 of the moveable pawl 100. In the arrangement as seen in the drawings, the second rotating member 140 has a peripheral edge 144, and a support member 153 is made integral with the second rotating member 140. The second rotating member has a distal end 155, which extends laterally, outwardly, relative to the peripheral 144, and is further located in spaced relation relative to the first rotating member 70. The support member 153 has a top and bottom surface 153A and B, respectively. As seen in the drawings, first and second engagement posts 156 and 157, respectively, are mounted on the bottom surface 153B of the support member 153 and further extend in the direction of, but do not engage, the first rotating member 70.

Figure 20:
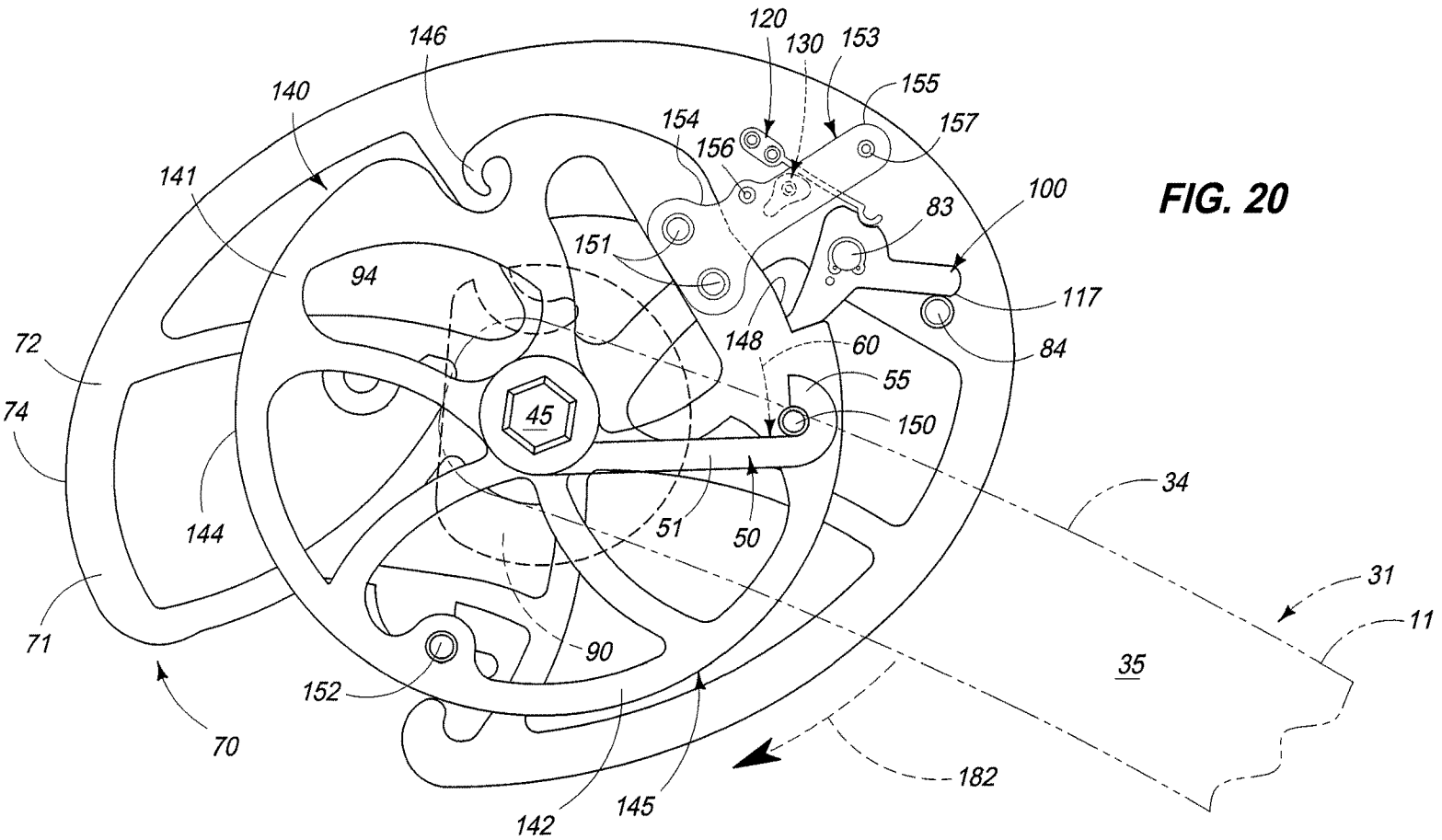
FIG. 20 is a later in time, fragmentary, side elevation view of the first and second rotating members of the present invention, and which illustrates the first rotating member forcibly engaging the second rotating member, and moving in the second direction.
Figure 24:
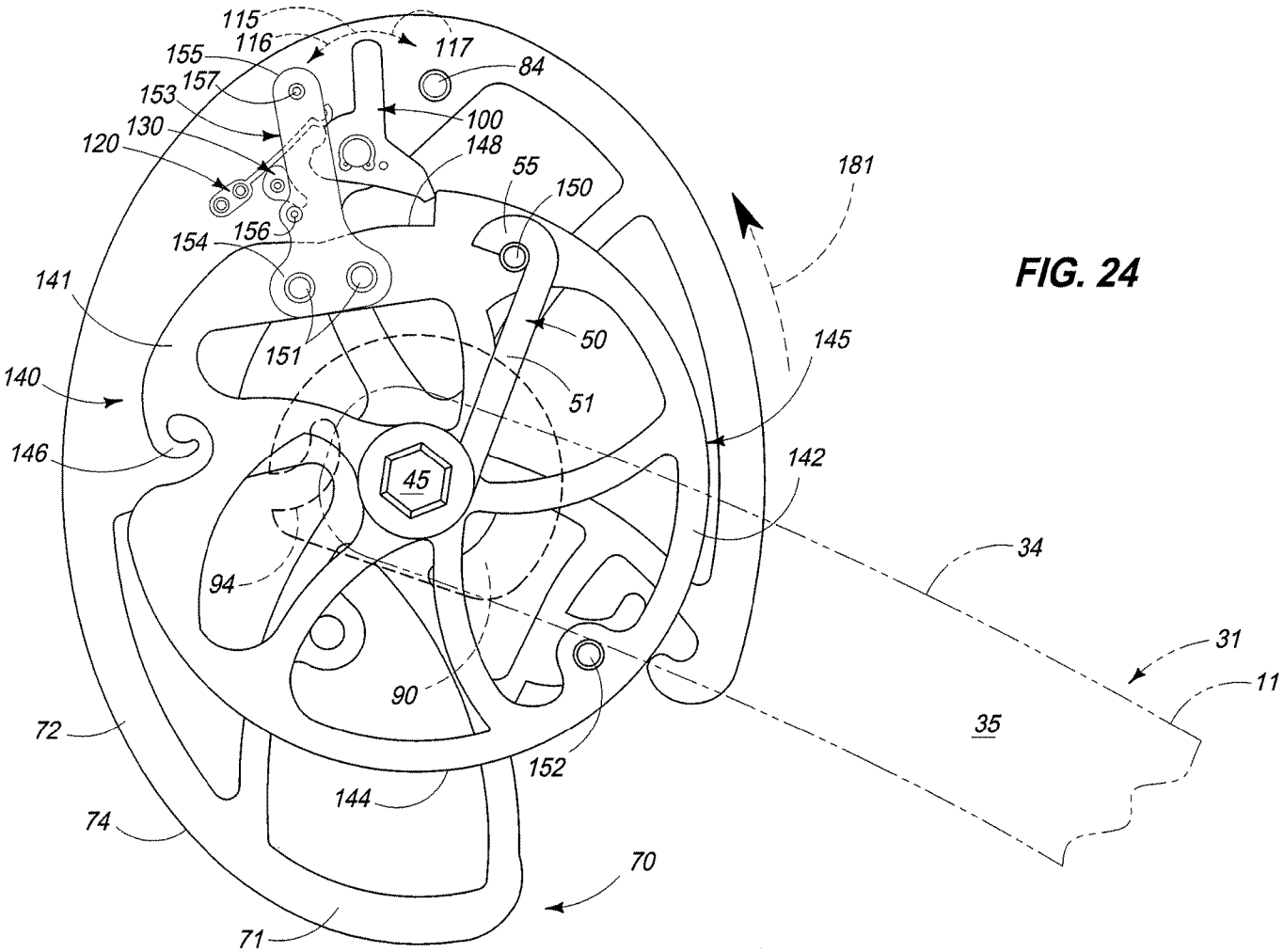
FIG. 24 is a later in time, fragmentary, side elevation view of the first and second rotating members co-rotating in the first direction, and illustrating the first rotating member beginning to forcibly disengage from the second rotating member.
Figure 25:
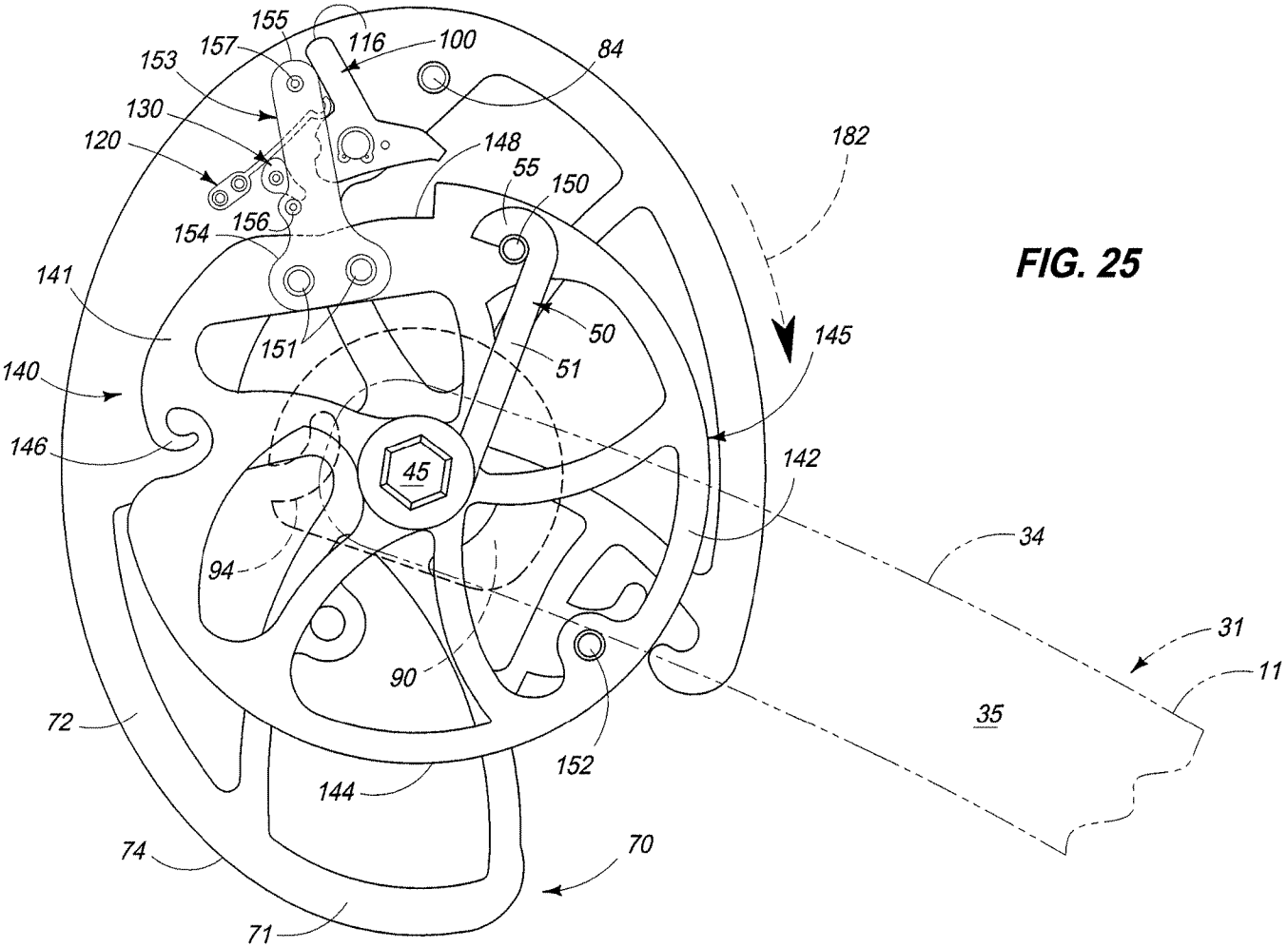
FIG. 25 is a later in time, fragmentary, side elevation view of the first and second rotating members, and illustrating the first rotating member forcibly disengaged from the second rotating member, and beginning to rotate in the second direction.

In the preferred embodiments of the invention as shown, the archery bow 10 includes a rotating camming member 130 which is mounted on the first rotating member 70, and which is further located in spaced relation relative to the resilient restraining member 120. The rotating camming member 130 has a first, and a second end 133 and 134, respectively. Upon rotation of the first rotating member 70 relative to the second rotating member 140, and in the first direction 181, the first end 133 of the first rotating camming member 130 forcibly engages the first post 156, which is mounted on the support member 153, so as to cause the second end 134 of the rotating camming element 130 to rotate, and then forcibly engage the resilient restraining member 120 (FIGS. 24 and 25). This above-mentioned rotation urges the resilient restraining member 120 out of forcible restraining engagement with the moveable pawl 100 (FIG. 16). Further rotation of the first rotating member 70, relative to the second rotating member 140, and in the first direction 181, causes the engagement member 104 of the moveable pawl 100 to forcibly come into contact with, and engage, the second post 157 and thereby effect, at least in part, rotation of the moveable pawl 100 from the first position 116, to the second position 117 (FIG. 17), and where the moveable pawl 100 then engages the pawl restraining post 84. After this event has occurred, a rotation of the first rotating member 70 in an opposite, second direction 182 relative to the second, rotating member 140, causes the force transmitting member or portion 103, of the moveable pawl 100, to move or come into forcible engagement or contact with the second rotating member 140 (FIG. 19). This is affected by the force transmitting portion 103 entering into, or otherwise matingly cooperating with the engagement notch 148, which is defined by the second rotating member 140. A further rotation of the first rotating member 70, in the second direction 182, is effective in causing co-rotation of the first and second rotatable members 70/140 (FIGS. 20 and 21). As should be understood, and in the arrangement as illustrated, the first biasing member 51/52 biasingly or forcibly resists the co-rotation of the first and second rotating members 70/140 as the first and second rotating members rotate in the second direction 182. Additionally, it should be recognized that the first biasing member 51/52 forcibly assists in the co-rotation of the first and second rotating members 70/140 when the first and second rotating members 70 and 140, respectively, co-rotate together in the first direction 181. Moreover, it should be understood that when the moveable pawl 100, is located in the first position 116, and is not located in the engagement notch 148, the first rotating member 70 is operable to rotate in the first and second directions 181 and 182, respectively, while the second rotating member 140 remains substantially stationary relative to the first rotating member 70. (FIGS. 10-16, respectively.)

Figure 4:
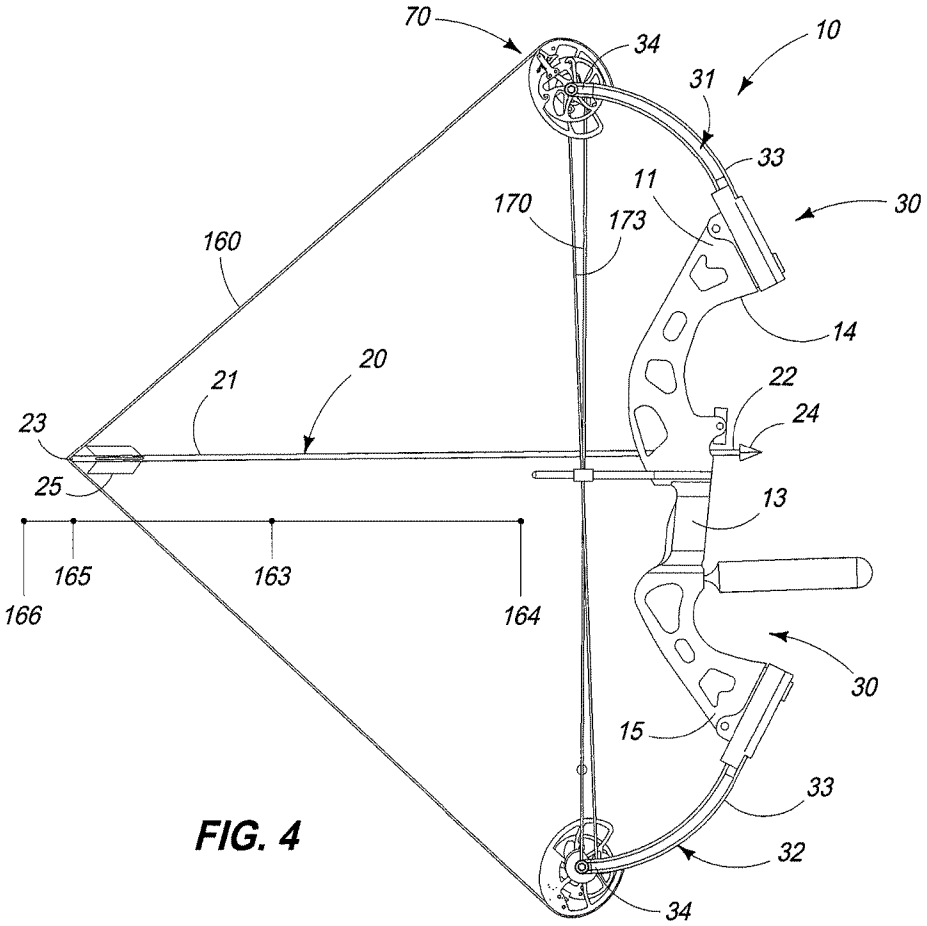
FIG. 4 is a perspective, side elevation view of the first form of the present invention, and which illustrates the string or cable in a second, arrow release position.
Figure 5:
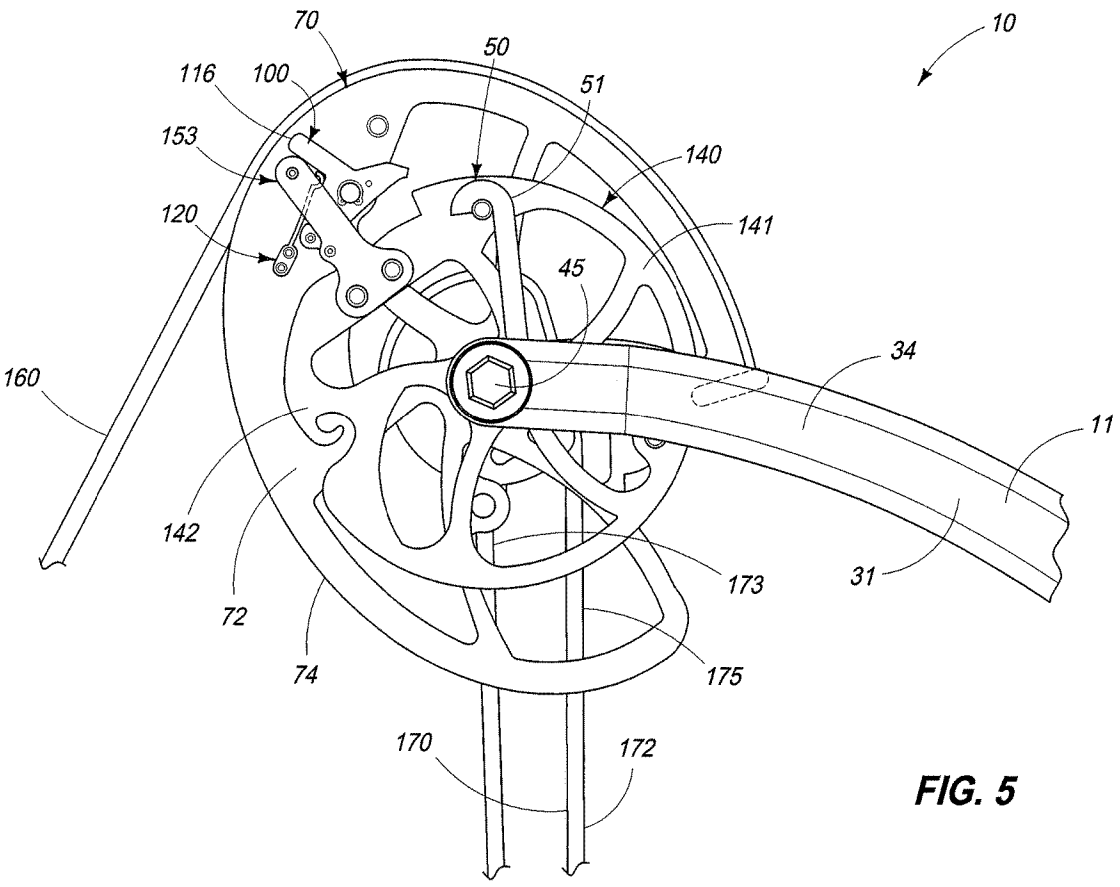
FIG. 5 is a fragmentary, greatly enlarged, side elevation view of the first and second rotating members of the present invention, and where the string or cable of the archery bow is located in the second, arrow release position as seen in FIG. 4.
Figure 6:
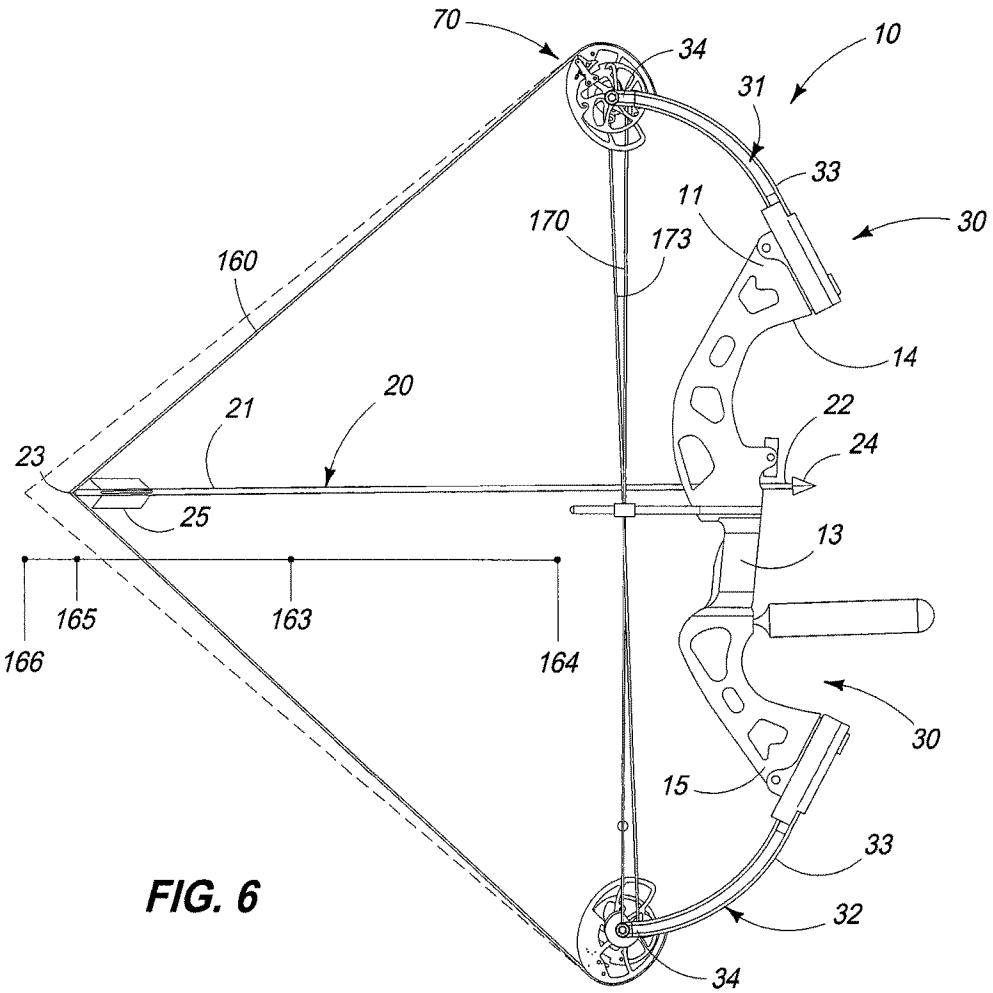
FIG. 6 is a side elevation view of the first form of the archery bow of the present invention, and which illustrates the string or cable of the archery bow located in a third, string return position.
Figure 7:
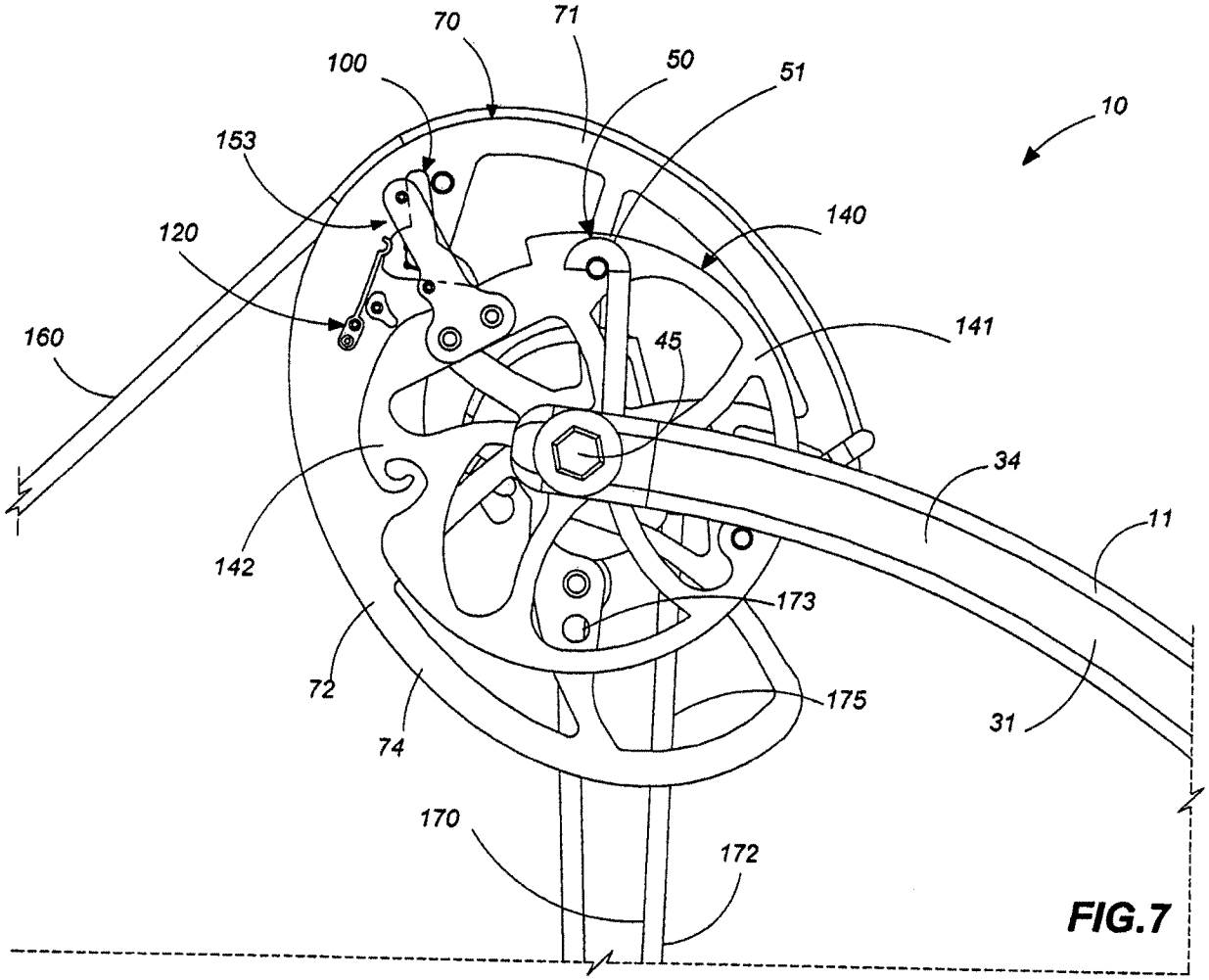
FIG. 7 is a fragmentary, greatly enlarged, side elevation view showing the position of the first and second rotating members when the string or cable of the archery bow is located in the third, string return position as seen in FIG. 6.

In the invention as shown in the drawings, it should be understood that an arrow 20 can be placed into releasable engagement with the string 160, and can be forcibly drawn by an archer, not shown, from the first, at rest position 164 (FIG. 1), to the second, distant, arrow release position 165 (FIG. 4). In the second, distant, arrow release position 165, the moveable pawl 100 is located in the first position 116 (FIG. 13) where the moveable pawl 100 does not forcibly engage the second rotating member 140 and is thus, freely rotatable in both the first and second directions 181 and 182, respectively. As should be understood, when the string 160 is released from the second, distant, arrow release position 165, the string 160 returns to the first, at rest position 164, and is operable to propel the arrow 20 away from the archery bow 10. Additionally it should be recognized that the string 160 further can be drawn by the archer [not shown] from the second, arrow release position 165, to the third, and still further distant, string return position 166 (FIG. 4). In the third, and still further distant string return position 166 the moveable pawl 100 moves along the path of travel 115 from the first position 116 towards the second position 117 (FIGS. 16-19). This movement of the string 160 from the third, and further distant string return position 166, and towards the first, at rest position 164 causes the moveable pawl 100 to engage or matingly cooperate with the second, rotating member 140, and thereby effects the simultaneous co-rotation of the first and second rotating members 70 and 140, respectively, and in the second direction, 182. The first biasing member 51/52 selectively, biasingly resists the co-rotation of the first and second rotating members to assist the archer in returning the arrow from the further distant third string return position 166, to the first at rest position 164. Additionally, it will be recognized that by the use of the tool 48 (FIG. 3), the second rotation member 140 may be rotated in the second direction 182, thereby causing the first rotating member 70 to engage or matingly cooperate with the second rotating member 140 by the movement of the pawl 100. This rotation of the second rotating member 140 causes the biasing member 50 to exert an assistive biasing influence on the first rotating member 70 when the string 160 is forcibly pulled or drawn from the first, at rest position 164, and towards the second, arrow release position, 165. As noted earlier, when this event occurs, an archer (not shown) experiences a biased assistance while drawing the string from the first, at rest position 164, to the second, arrow release position, 165. As earlier discussed, and with this feature, an archer of somewhat limited physical strength can draw or otherwise utilize an archery bow having greater strength, than that which was possible, heretofore.

Another broad aspect of the present invention relates to an archery bow 10 which includes a resilient, elongated main body 30, having opposite, distal ends 34; a first rotating member 70 which is mounted on at least one of the distal ends 34 of the resilient main body 30, and which rotates about a predetermined axis as defined by the axle 40; a second rotatable member 140 mounted on the distal end 34 of the resilient main body 30, and which is selectively, forcibly co-rotatable with the first rotating member 70, and which further rotates about the same predetermined axis as defined by the axle 40; and a string 160, which extends to, and is tensioned between, the distal ends 34 of the resilient main body 30 and which forcibly cooperates with the first rotatable member 70.

Another aspect of the present invention relates to an archery bow 10, which includes a first and a second limb 31 and 32, respectively, and where each has a distal end 34. A handle 13 is located between, and mounted to, each of the first and second limbs 31 and 32, respectively. Still further, the archery bow 10 includes a first rotating member 70 which is mounted on the distal end 34 of one of the first or second limbs 31 and 32, and a second rotating member 140 is mounted on the distal end 34 of one of the first or second limbs 31 and 32, respectively, and which is selectively co-rotatable with the first rotating member 70. The archery bow 10 further includes a first biasing member 51/52, which selectively, biasingly resists and/or assists, in the co-rotation of the first and second rotating members 140. Further, the invention as shown in the drawings has a string 160 which extends between the first rotating member 70 and the opposite limb.

Figure 22:
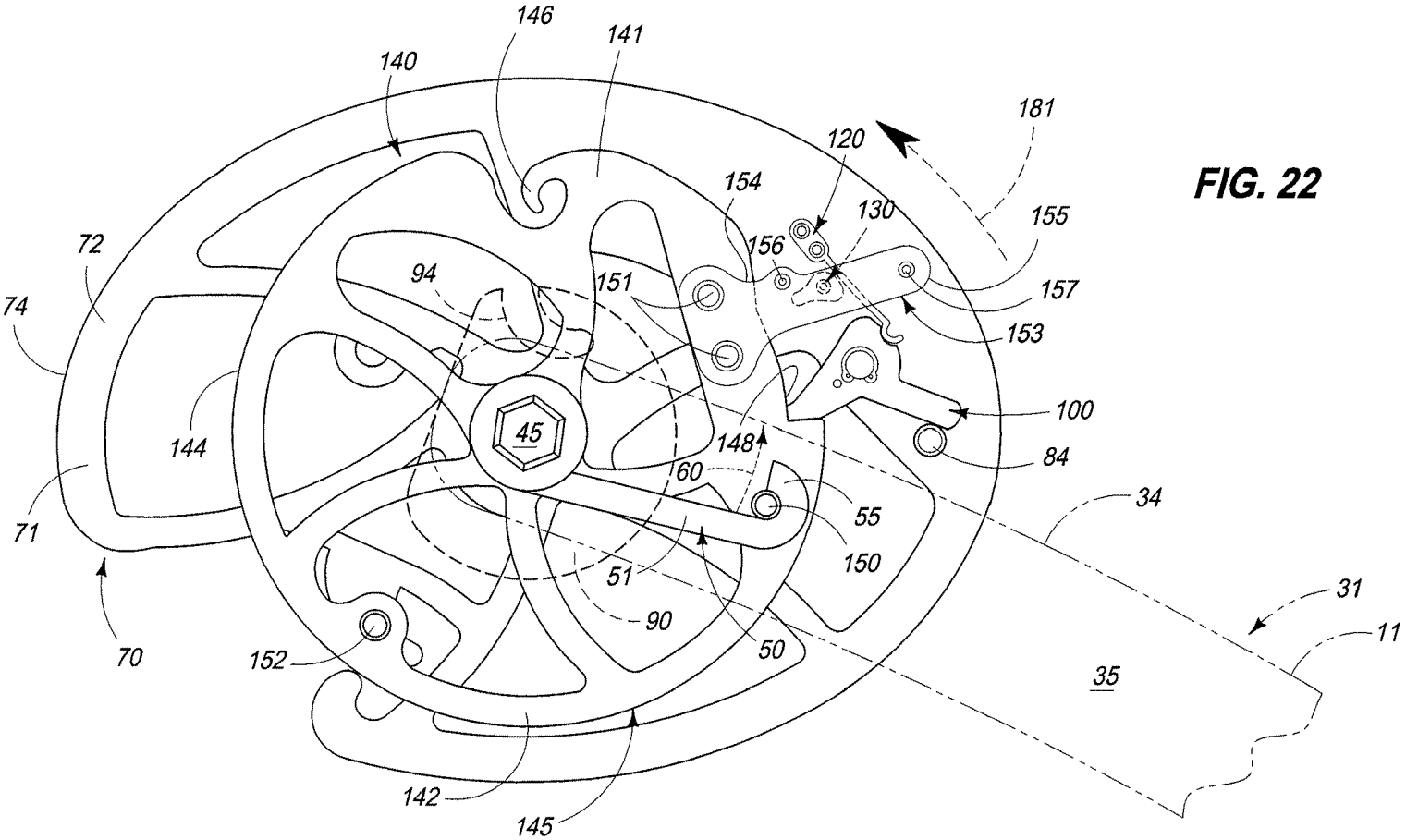
FIG. 22 is a later in time, fragmentary, side elevation view of the first and second rotating members co-rotating together, and moving in the first direction.
Figure 23:
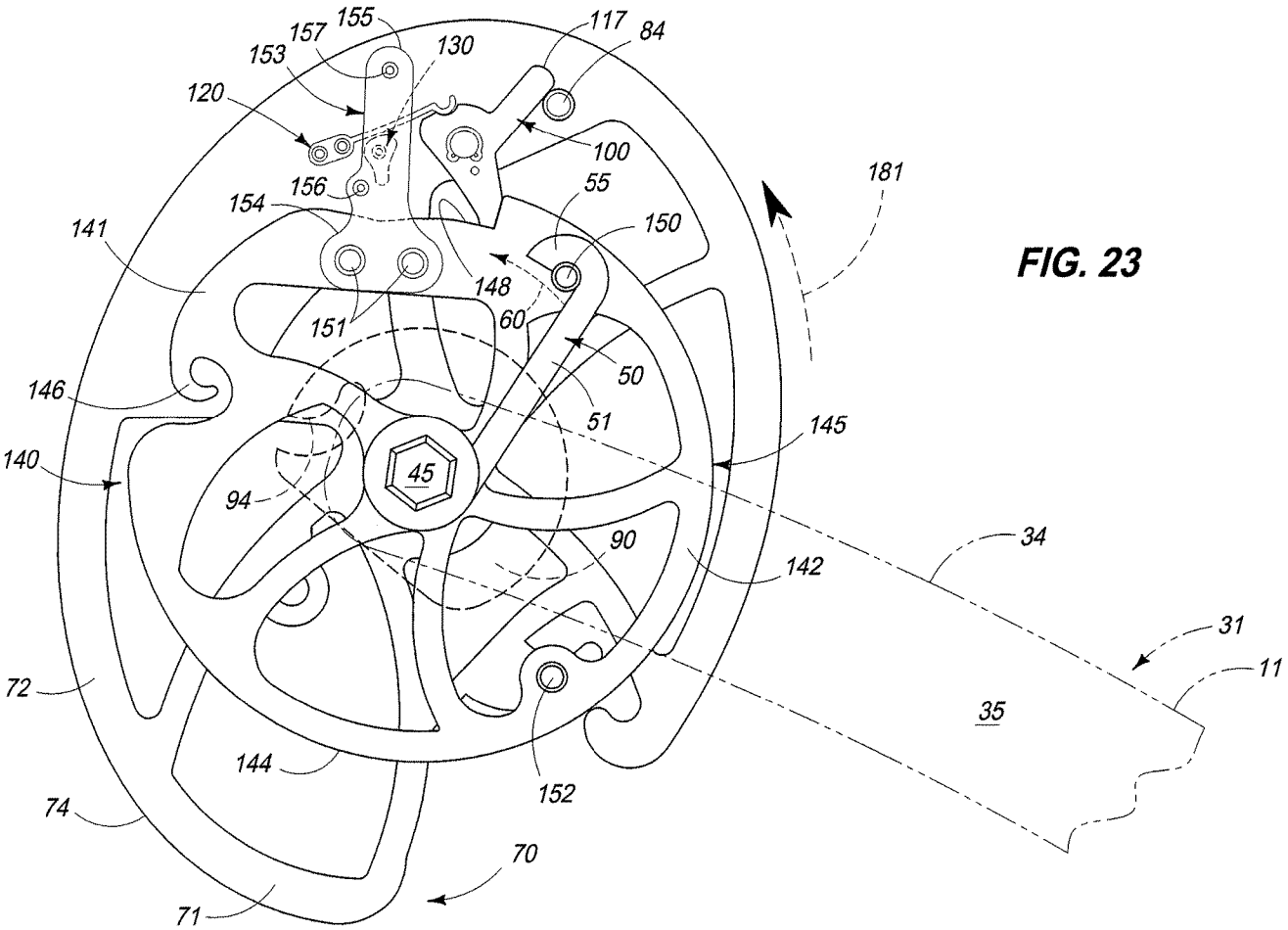
FIG. 23 is a later in time, fragmentary, side elevation view of the first and second rotating members co-rotating together, and moving in the first direction.

As will be recognized by studying the drawings, and specifically FIG. 21, when the string 160 carrying the arrow 20 reaches the first, at rest position 164, (FIG. 1), after having been previously drawn to, and then slowly, controllably, returned from the third, string return position 166, the archer can then re-draw or pull the string 160 back towards the second arrow release position 165. Under these circumstances, the archer, upon drawing the string 160 from the first, at rest position 164, to the second arrow release position 165, causes both the first and second rotating members 70 and 140, respectively, to co-rotate in the first direction 181 (FIG. 22). Further, and under these circumstances the biasing member 50 is operable to biasingly or forcibly assist the archer in drawing the string 160 to the second, arrow release position 165. Upon drawing the string 160 towards the second, arrow release position 165, the second rotating member 140 stops co-rotation with the first rotating member 70 when the rotation restraining post 152, which is mounted on the main body of the second rotating member 140, comes into contact with the distal end 34 of one of the first or second limbs 31 and 32, respectively (FIG. 24). It should be understood that further rotatable movement of the first rotating member 70 in the first direction 181 is then effective in causing the disengagement of the moveable pawl 100 from the second rotating member 140 (FIG. 25). Upon the disengagement of the moveable pawl 100 from the second rotating member 140, the moveable pawl 100, under the biasing influence exerted by the second biasing member 111, moves along the path of travel 115 from the second position 117, to the first position 116, and out of the engagement notch 148 (FIG. 25). After the previously mentioned event has occurred, the release of the string 160 from the second arrow release position 165 is then effective in propelling the arrow 20 away from the archery bow 10. In another possible form of the invention, which is not shown, the biasing member may be rendered operable to assist in biasingly, forcibly propelling an arrow from the second, arrow release position.

Therefore, it will be seen that the present invention provides a greatly improved archery bow having features and operational characteristics which have not been available in the prior art compound archery bows of similar design. Further, the present archery bow avoids many of the design shortcomings of the prior art, and additionally provides a convenient means whereby an archer may easily draw or release a fully drawn arrow and place it back into position where it can be redrawn again in a manner not possible heretofore.

In compliance with the statute, the present invention has been described in the language more or less specific as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

We claim:

1. An archery bow, comprising:

a resilient main body having opposite, distal ends;

a biasing member borne by the main body; and a string extending and tensioned between the distal ends, the string having a first, at rest position;

a second, arrow release position; and a third, string return position, the biasing member biasingly resists the movement of the string from the third, string return position, to the first, at rest position, and the biasing member does not biasingly resist the movement of the string from the second, arrow release position, to the first, at rest position when the third, string return position is not reached.

2. An archery bow as claimed in claim 1, and wherein the biasing member is operable to biasingly assist in the movement of the string from the first, at rest position, to the second, arrow release position.

3. An archery bow as claimed in claim 1, and wherein the second, arrow release position is located at a predetermined first distance from the first, at rest position, and wherein the third, string return position is located at a predetermined second distance from the first, at rest position, and wherein the second distance is greater than the first distance.

4. An archery bow as claimed in claim 1, and wherein the biasing member comprises, at least in part, a torsion spring.

5. An archery bow as claimed in claim 1, and wherein the biasing member comprises a planar biasing member which is located on at least one of the distal ends of the main body.

6. An archery bow as claimed in claim 1, and further comprising:

a first rotating member mounted on at least one of the distal ends of main body, and wherein the string forcibly engages the first rotating member; and a second rotating member mounted on at least one of the distal ends of the main body, and which is further located in spaced, substantially parallel relationship relative to the first rotating member, and which is further selectively co-rotatable with the first rotating member in opposite directions, and wherein the biasing member biasingly cooperates with the second rotating member, and wherein the first and second rotating members co-rotate together when the string moves from the third, string return position to the first, at rest position.

7. An archery bow as claimed in claim 6, and wherein the second rotating member is operable to co-rotate with the first rotating member when the string moves from the first, at rest position, to the second, arrow release position.

8. An archery bow as claimed in claim 7, and further comprising:

a moveable pawl borne by the first rotating member and which is operable to move along a path of travel from a first position, where the moveable pawl is spaced from the second rotating member, to a second position, where the moveable pawl forcibly engages the second rotating member so as to cause the first and second rotating members to co-rotate together, and wherein during co-rotation of the first and second rotating members the first biasing member biasingly resists or assists in the corotation of the first and second rotating members, and further biasingly resists the movement of the string from the third, string return position, to the first, at rest position, and biasingly assists in the movement of the string from the first, at rest position, to the second, arrow release position.

9. An archery bow as claimed in claim 1, wherein the biasing member forcibly assists in propelling an arrow when the string is released from the second, arrow release position, and returns to the first, at rest position.

10. An archery bow, comprising:

a bow body including a first rotating member and a second rotating member;

a biasing member coupled to the second rotating member;

a string adapted for extending from the bow body over the first rotating member; and an engagement member disposed between the first rotating member and second rotating member.

11. The archery bow of claim 10, wherein the engagement member is configurable to assist with movement of the string from a rest position to a release position relative to the bow body.

12. The archery bow of claim 10, wherein the engagement member is configurable to engage the biasing member and resist movement of the string from a return position to a rest position relative to the bow body.

13. The archery bow of claim 10, wherein the engagement member includes a pawl coupled to the first rotating member, wherein the pawl is moveable to contact a notch in the second rotating member.

14. The archery bow of claim 10, wherein the biasing member includes a torsion spring coupled between the second rotating member and bow body.

15. The archery bow of claim 10, wherein the biasing member includes a resilient planar body coupled between the second rotating member and bow body.

16. An archery bow, comprising:

a bow body;

a first rotating member coupled to the bow body;

a second rotating member coupled to the bow body;

a string adapted for extending from the bow body over the first rotating member;

a biasing member coupled to the second rotating member; and an engagement member disposed between the first rotating member and second rotating member.

17. The archery bow of claim 16, wherein the engagement member is configurable to assist with movement of the string from a rest position to a release position relative to the bow body.

18. The archery bow of claim 16, wherein the engagement member is configurable to engage the biasing member and resist movement of the string from a return position to a rest position.

19. The archery bow of claim 16, wherein the engagement member includes a pawl coupled to the first rotating member, wherein the pawl is moveable to contact a notch in the second rotating member to engage the biasing member.

20. The archery bow of claim 16, wherein the biasing member includes a torsion spring coupled to the second rotating member.

21. The archery bow of claim 16, wherein the biasing member includes a resilient planar body coupled to the second rotating member.

22. A method of making an archery bow, comprising:

providing a bow body;

providing a first rotating member for coupling to the bow body;

providing a second rotating member for coupling to the bow body;

providing a string adapted for extending from the bow body over the first rotating member;

providing a biasing member for coupling to the second rotating member; and disposing an engagement member between the first rotating member and second rotating member.

23. The method of claim 22, wherein the engagement member is configurable to assist with movement of the string from a rest position to a release position relative to the bow body.

24. The method of claim 22, wherein the engagement member is configurable to engage the biasing member and resist movement of the string from a return position to a rest position.

25. The method of claim 22, wherein disposing the engagement member includes providing a pawl coupled to the first rotating member, wherein the pawl is moveable to contact a notch in the second rotating member to engage the biasing member.

26. The method of claim 22, wherein the biasing member includes a torsion spring coupled to the second rotating member.

27. The method of claim 22, wherein the biasing member includes a resilient planar body coupled to the second rotating member.

* * * * *